US005259803A

United States Patent [19]

Lyman

[11] Patent Number: 5,259,803

[45] Date of Patent: Nov. 9, 1993

[54] TOY CONSTRUCTION SET FEATURING GEARS AND RADIANT CONNECTORS

[76] Inventor: Ronald L. Lyman, 235 Cascade Falls Dr., Folsom, Calif. 95630

[21] Appl. No.: 682,730

[22] Filed: Apr. 9, 1991

[51] Int. Cl.[5] ..... A63H 33/12; A63H 33/08; A63H 33/06

[52] U.S. Cl. ..... 446/103; 446/116; 446/120; 446/125; 446/128

[58] Field of Search ..... 446/103, 102, 104, 105, 446/108, 116, 120, 121, 122, 123, 124, 125, 128

[56] References Cited

U.S. PATENT DOCUMENTS

| | | | |
|---|---|---|---|
| 171,533 | 6/1875 | Schmetzer . | |
| 1,405,851 | 2/1922 | Lewis . | |
| 1,554,095 | 9/1925 | Hultman . | |
| 2,708,329 | 5/1955 | McKee . | |
| 2,776,521 | 1/1957 | Zimmerman . | |
| 2,972,833 | 2/1961 | Grutta . | |
| 3,005,282 | 10/1961 | Christiansen . | |
| 3,032,919 | 5/1962 | Amsler . | |
| 3,162,973 | 12/1964 | Christiansen | 446/128 |
| 3,172,666 | 3/1965 | Ryan | 446/103 X |
| 3,193,293 | 7/1965 | Schaper | 446/103 X |
| 3,233,358 | 2/1966 | Dehm | 446/128 X |
| 3,242,610 | 3/1966 | Christiansen . | |
| 3,374,917 | 3/1968 | Troy | 446/125 X |
| 3,392,480 | 7/1968 | Stubbmann . | |
| 3,461,601 | 8/1969 | Kristiansen | 446/128 X |
| 3,486,269 | 12/1969 | Fischer | 446/103 |

(List continued on next page.)

FOREIGN PATENT DOCUMENTS

| | | | |
|---|---|---|---|
| 100283 | 2/1937 | Austria | 446/122 |
| 184497 | 1/1956 | Austria | 446/128 |
| 0104716 | 4/1984 | European Pat. Off. | 446/103 |
| 109181A | 5/1984 | European Pat. Off. . | |
| 89/00069 | 1/1989 | European Pat. Off. . | |
| 2429491 | 1/1975 | Fed. Rep. of Germany . | |
| 3502147 | 8/1985 | Fed. Rep. of Germany | 446/128 |
| 1144481 | 10/1957 | France | 446/128 |
| 1149918 | 1/1958 | France | 446/122 |
| 1311992 | 11/1962 | France | 446/120 |
| 2534484A | 4/1984 | France . | |
| 413963 | 7/1934 | United Kingdom | 446/103 |
| 740951 | 11/1955 | United Kingdom . | |
| 976761 | 12/1964 | United Kingdom | 446/128 |
| 1008459 | 10/1965 | United Kingdom | 446/128 |
| 1167678 | 10/1969 | United Kingdom . | |
| 1212537 | 11/1970 | United Kingdom . | |
| 1382134 | 1/1975 | United Kingdom . | |

*Primary Examiner*—Robert A. Hafer
*Assistant Examiner*—D. Neal Muir
*Attorney, Agent, or Firm*—Bernhard Kreten

[57] ABSTRACT

A construction toy formed from a plurality of building blocks. A primary form of building block is formed as a wafer-shaped rectangle having top and bottom surfaces formed of complemental interconnectable arrays of posts or rectangular vanes on a top surface and parallel-walled channels on a bottom surface allowing the blocks to stack and lock top-to-bottom. The sides of the primary building blocks have complemental prominences and orifices or projections and grooves which can connect together allowing the blocks to stack side-to-side. Orifices are also located in a portion of the top surface, usable in any way the orifices of the side surfaces are usable. A secondary form of building block is a round wafer-shaped block with beveled gear teeth along a side wall of the block. The secondary block has posts on a top surface and vanes, similar to the primary blocks, and has a hub on a bottom surface. The hub is rotationally receivable within the orifices of the primary blocks. Secondary blocks may be attached to primary blocks in an interfacing pattern allowing a user to construct representations of both planar gear pairs and beveled gear pairs. A third form of building block, as does the primary form, among other things, attaches rotationally to the top surface of the secondary block, acting as an input driver for an assembly of secondary blocks.

34 Claims, 8 Drawing Sheets

U.S. PATENT DOCUMENTS 3,494,218 2/1970 Fischer ..... 446/103 X
3,496,670 2/1970 Sloop et al. .
3,603,025 9/1971 Heubl .
3,604,145 9/1971 Zimmerman .
3,624,955 2/1969 Matsubayshi et al. ..... 446/128 X
3,740,895 6/1973 Nagasaka .
3,867,784 2/1975 Lange .
3,894,354 7/1975 Crawley .
3,895,456 7/1975 Fabre .
3,965,610 6/1976 Den Ouden ..... 446/103
4,003,144 1/1977 Maddestra et al. ..... 446/122 X
4,055,019 10/1977 Harvey .
4,080,742 3/1978 Osterried .
4,090,322 2/1978 Hake .
4,185,410 1/1980 Kristiansen .
4,214,403 7/1980 Knudsen .
4,253,268 3/1981 Mayr .
4,257,207 3/1981 Davis .
4,270,303 6/1981 Xanthopoulos et al. .
4,306,373 12/1981 Chatani et al. ..... 446/121
4,606,732 8/1986 Lyman .
4,642,064 2/1987 Yoke .
4,731,041 3/1988 Ziegler ..... 446/104 X
4,764,144 8/1988 Lyman .
4,789,369 12/1988 Lyman .
4,792,319 12/1988 Svagerko .
4,813,903 3/1989 Furukawa et al. ..... 446/103 X
5,022,885 6/1991 Lyman ..... 446/95
5,073,138 12/1991 Klitsner et al. ..... 446/103

TOY CONSTRUCTION SET FEATURING GEARS AND RADIANT CONNECTORS

FIELD OF THE INVENTION

The following invention relates generally to an instrumentality for creating objects of amusement formed from a plurality of blocks for children. The blocks are interconnected such that they stimulate a child's imagination and creativity to form structures and more specifically, structures which include interfacing gears rotating in a variety of distinct planes.

BACKGROUND OF THE INVENTION

The instant invention reflects an ongoing evolution of structure, disclosed in U.S. application Ser. No. 07/419,095 filed Oct. 10, 1989 and Ser. No: 07/491,081 filed Mar. 9, 1990, to the instant inventor.

The prior art is relatively rich in attempts at providing construction blocks for children which challenge the child's imagination yet are not so complex as to frustrate the child in his creative endeavors. Not surprisingly, many known patents can be grouped into the above noted objection categories as being either too simple or too complex.

The following patents reflect the state of the art of which applicant is aware and are included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| INVENTOR | PATENT NO. | ISSUE DATE |
|---|---|---|
| Schmetzer | 171,533 | December 28,1875 |
| Lewis | 1,405,851 | February 7,1922 |
| Hultman | 1,554,095 | September 15, 1925 |
| McKee | 2,708,329 | May 17, 1955 |
| Aureillan | BR740,951 | November 23, 1955 |
| Zimmerman | 2,776,521 | January 8, 1957 |
| Grutta | 2,972,833 | February 28, 1961 |
| Christiansen | 3,005,282 | October 24, 1961 |
| Amsler | 3,032,919 | May 8, 1962 |
| Christiansen | 3,162,973 | December 29, 1964 |
| Christiansen | 3,242,610 | March 29, 1966 |
| Stubbmann | 3,392,480 | July 16, 1968 |
| Playcraft Toys, Inc. | BR1,167,678 | October 22, 1969 |
| Sloop et al. | 3,496,670 | February 24, 1970 |
| Shackelton | BR1,212,537 | November 18, 1970 |
| Huebl | 3,603,025 | September 7, 1971 |
| Zimmerman | 3,604,145 | September 14, 1971 |
| Nagasaka | 3,740,895 | June 26, 1973 |
| Bakker | DT2,429,491 | January 16, 1975 |
| Lange | 3,867,784 | February 25, 1975 |
| Retzler & Knight | BR1,382,134 | January 29, 1975 |
| Crawley | 3,894,354 | July 15, 1975 |
| Fabre | 3,895,456 | July 22, 1975 |
| Harvey | 4,055,019 | October 25, 1977 |
| Osterried | 4,080,742 | March 28, 1978 |
| Hake | 4,090,322 | May 23, 1978 |
| Kristiansen | 4,185,410 | January 29, 1980 |
| Knudsen | 4,214,403 | July 29, 1980 |
| Mayr | 4,253,268 | March 3, 1981 |
| Davis | 4,257,207 | March 24, 1981 |
| Xanthopoulos et al. | 4,270,303 | June 2, 1981 |
| Bersani | FR2534-484-A | April 20, 1984 |
| Inskip | EP-109-181-A | May 23, 1984 |
| Lyman | 4,606,732 | August 19, 1986 |
| Yoke | 4,642,064 | February 10, 1987 |
| Ziegler | 4,731,041 | March 15, 1988 |
| Lyman | 4,764,144 | August 16, 1988 |
| Lyman | 4,789,369 | December 6, 1988 |
| Svagerko | 4,792,319 | December 20, 1988 |

-continued

| INVENTOR | PATENT NO. | ISSUE DATE |
|---|---|---|
| Heiremans | EP-89/00069 | January 12, 1989 |

The patent to Playcraft Toys, Inc. teaches discreet blocks having a rotational interfacing means comprised of a plurality of pins with spherical knobs on ends thereof which fit into spherical bores in the blocks. The applicant's invention is distinguishable from Playcraft Toys, however, in that blocks in the applicant's invention come into direct contact with each other and may rotate perpetually without reaching a rotational restriction. Other distinctions are also apparent.

The Zimmerman patent teaches that flexible blocks may be formed into circular constructs with a plurality of knobs and gaps alternating along a side edge. The Zimmerman patent teaches knobs and gaps which merely fasten to each other, rather than interfacing as taught by the applicant's invention. The applicant's invention also shows hubs allowing gear shaped blocks to be rotationally received upon separate mounting blocks. The Zimmerman patent does not teach any use of hubs or other mounting means allowing rotation about a central axis.

The remainder of the prior art listed above further show the state of the art of which applicant is aware. Each of these references is also distinguishable from the applicant's invention because the instant invention diverges more starkly from their teachings.

SUMMARY OF THE INVENTION

In general, the instant invention shows many of the attributes of applicant's earlier filed applications.

The instant invention is also distinguished over the known prior art in a plurality of ways. In general, the primary blocks forming the instant invention assume a substantially wafer-like configuration having a top surface and a bottom surface. The top surface has a first attachment means which is complemental to a second attachment means on the bottom surface. The first attachment means of the top surface may interface with the second attachment means of the bottom surface allowing a plurality of blocks of similar construction to be stacked and locked together one on top of the other.

In practice, the attachment means of the top surface is preferably a plurality of linear vanes which radiate from the center of the top surface. An alternative attachment means is a plurality of posts oriented in linear rows which radiate out from a center of the top surface of the primary blocks. The posts can be oriented in a variety of successful patterns. The posts have a toroidal flair near an outer end which extends around each post in a plane horizontal to the top surface.

The attachment means of the bottom surface is a plurality of channels which extend radially outwardly from a center of the bottom surface of the primary blocks. Alternatively, the channels can circumscribe the bottom surface in a concentric manner. Each channel is formed from a pair of walls extending outward from the bottom surface orthogonal to the bottom surface of the primary blocks. In one form of the invention a ledge is formed on a side of each wall, facing its complemental channel wall pair, which extends inwardly and in a plane horizontal to the bottom surface of the primary blocks.

When the top surface of one primary block is brought into contact with the bottom surface of another primary block the posts or vanes of the top surface fit within the channels of the bottom surface and the toroidal flair of each post snaps snugly above the ledge formed in the walls of the channels of the bottom surface. Two primary blocks may thus be connected top-to-bottom in a variety of different ways by holding one block in position and rotating the other primary block or displacing the other block linearly. The walls of the channels on the bottom surface of the primary blocks are substantially parallel to each other. The posts are all of similar shape.

Secondary blocks are included which assume a substantially wafer-like configuration having a top surface and a bottom surface. The top surface of each secondary block is similar to the top surface of each primary block. The bottom surface, however, has a hub which is a hollow cylindrical construct extending downwardly perpendicular to the bottom surface of the secondary block. The secondary blocks have one curved side edge making the secondary blocks substantially circular in cross-section. Along the side edge of the secondary blocks are formed a plurality of beveled gear teeth. These gear teeth allow pairs of secondary blocks to interface in a rotational manner, with one gear being able to cause the other gear to rotate. The gear teeth of the secondary blocks are beveled to allow the pairs of secondary blocks to be oriented with their top surfaces in planes not parallel with each other, thus forming a beveled gear pair.

The primary blocks have along their side surfaces a plurality of complemental prominences and orifices. Each side of the primary blocks has either a prominence or an orifice with the prominences being of a design somewhat similar to that of the hubs of the secondary blocks. The orifices of the primary blocks are cylindrical cavities which extend inwardly perpendicular to the side surfaces of the primary blocks. Extending longitudinally along a side surface of the orifices are a plurality of undulations. The prominences of the primary blocks have a plurality of ribs extending longitudinally along side walls of the prominences.

The prominences are of complemental shape to the orifices such that a pair of primary blocks may be connected together along side surfaces with a prominence fitting securely within an orifice with the ribs and undulations preventing rotation. A hub of a secondary block may fit within an orifice of a primary block restricting the block pair from relative translation but allowing the hub of the secondary block to rotate within the orifice of the primary block. An orifice can also be located on the top surface of said primary block. This allows a side surface of the primary block to be attached to a top surface of another primary block.

The primary blocks are of two different sizes. Some primary blocks are full size, characterized by being equal in length on a long side to a pitch circle of the secondary blocks. This size allows two full size primary blocks, attached adjacently on side edges, to receive two secondary blocks which are then of sufficient separation to allow the gear teeth of the two separate secondary blocks to interface. Other primary blocks are essentially half size, characterized by being equal in length to the full size primary blocks in two directions but are half the length in a third direction. This size allows three half-size primary blocks, attached adjacently on side edges, to receive two secondary blocks within the orifices of the two outside half-size primary blocks. This orients the two secondary blocks with sufficient separation to allow the gear teeth of the two secondary blocks to interface, simulating the action of a planar gear pair.

Each primary block has orifices on three side surfaces and a prominence on one side surface. The orifices are oriented on the primary block such that two orifices on two adjacent sides are an equal distance from the corner between the two sides. This distance is equal to a radius of the pitch circle of the secondary blocks. The gear teeth of the secondary blocks are beveled at a 45° angle. When two secondary blocks are oriented orthogonally with their associated hubs within two adjacent orifices of the primary block, the gear teeth of the two secondary blocks interface. This orientation simulates the action of a beveled gear pair.

A plurality of primary blocks may be oriented along side surfaces, along top and bottom surfaces, or along both side and top surfaces and then a plurality of secondary blocks may connect to the assembly of primary blocks by placing the hubs of the secondary blocks within the orifices of the primary blocks. When configured in this way, the secondary blocks may interface with each other such that when one secondary block is rotated the entire set of interconnecting secondary blocks may all rotate. The bottom surface or the prominence of the primary blocks may connect to the top surface of the secondary blocks. This allows a primary block to rotate upon the top surface of the secondary block providing a handle by which a user may more easily apply an input rotational force to the system of secondary blocks.

A third block is also provided which is shaped to be readily connectable to the blocks described in U.S. application Ser. No. 07/419,095, Filed: Oct. 10, 1989 now U.S. Pat. No. 5,022,885 and also readily connectable with the primary blocks and the secondary blocks.

The third block is of a substantially wafer like configuration having a top surface and a bottom surface. The top surface is effectively the compliment of the bottom surface and vice versa. That is, each surface is formed with a series of projections and recesses. The recesses on one surface define the projections on the other surface. In this manner, a plurality of third blocks thus formed are capable of being stacked and locked one on top of the other.

In practice, the projections and associated recesses defining the top and bottom surfaces of the third blocks are oriented such that a plurality of radially extending vanes are provided on one surface and the corresponding complemental recesses on the opposite surface are provided between a plurality of radially extending wedges. Because of this symmetry, each third block has a "radiance" when viewing the top and bottom surfaces of the wafer shaped building block. By "radiance" it is meant to connote a center having radially diverging lines.

In the center of the third block is formed a cylindrical hole which completely intersects the third block. The cylindrical hole is sized to receive either a prominence of a primary block or a hub of a secondary block from either the top or bottom surface. The hole thus functions similarly to the orifices of the primary block.

Besides the top and bottom surfaces being inverse images of one another, each third block includes a plurality of peripheral side walls circumscribing the block provided with a further means for interconnecting adjacent third blocks. The interconnection means generally embraces one of two forms, either a projection or a channel. Side walls that include the circumscribing channel can therefore be connected with side walls having circumscribing projections by insertion of the projection into the channel. This channel can also connect with the vanes on the third block's top surface or the rows of posts or vanes of the primary block's top surface because the vanes, rows of posts and the projections have the same thickness. Side walls having a peripheral projection can also connect between the wedges formed on the bottom surface of the third block which defines the recesses or within the channels of the bottom surface of the primary blocks. Alternatively stated, the third blocks can be interconnected by stacking the surfaces, by placing an appropriate edge of the third block on a surface, or by connecting edges.

Because of the radiating pattern of the vanes and the associated wedges, orientation of the third blocks for interconnection is relatively neutral. Thus, two surfaces can be interconnected in such a manner that incremental rotation of under and overlying third blocks is possible so long as the rotational increment equals 360/2N degrees. N equals the number of sides on a block. Thus, where N equals 4, rotation of a block 45 degrees will allow it to be connected to its counterpart without difficulty. Similarly, because the peripheral sidewall is dimensioned such that its channel (or projection) on the peripheral sidewall corresponds to the thickness of the vane and row of posts (or recess), it too can be rotated when its edge is connected to a top or bottom third block surface.

In addition, because the radially directed vanes and complementally formed recesses occur along an axis of symmetry on the top and bottom surfaces, the third blocks can be interconnected only on sectors of the third block. This means that over and underlying third blocks can be terraced, forming imbrications or further tying third blocks together via overlap. This allows adjacent third blocks to be further interconnected so that one third block can interconnect with plural adjacent third blocks. Where N equals 4, the sectors are quadrants.

Moreover, the phenomena of overlaps can also be utilized to advantage with respect to the side wall channels and projections. These can overlap other sidewalls, vanes and recesses as will be developed.

Each third block having an even number of side walls preferably has an equal number of side walls with projections as side walls with channels. This allows a plurality of identical third blocks to be oriented serially along their side walls.

Succinctly stated, the instant invention spans the spectrum of complexity from a most simple toy to a most demanding, complex and creative toy to accommodate the interest pattern and skill level of the widest cross section of children and adults. The blocks themselves are capable of interconnection on all surfaces and also are capable of overlapping with adjacent blocks in a number of patterns. The blocks themselves are also both optically ornate and of complex contour to provide both a visual and tactile stimulus.

OBJECTS OF THE INVENTION

Accordingly, it is a primary object of the present invention to provide a novel and useful construction toy set.

A further object of the present invention is to provide a device as characterized above which is extremely simple to use thereby appealing to users having a modest skill level but also capable of manipulation by extremely creative people thereby spanning a broad spectrum in maintaining interest of users.

A further object of the present invention is to provide a device as characterized above which is both visually and tactilely stimulating.

It is yet a further object of the present invention to provide a device as characterized above which is extremely durable in construction, safe to use and lends itself to mass production techniques.

A further object of the present invention is to provide a device as characterized above which is dimensioned such that even young children can safely play with blocks forming the construction toy set.

A further object of the present invention is to provide a device as characterized above where blocks can be interconnected in a multiplicity of ways, thereby promulgating creativity and providing an extremely large number of possible structures buildable with this construction set.

A further object of the present invention is to provide a device as characterized above where gear shaped blocks may interface with gear teeth simulating the action of planar gears in a construction toy set.

A further object of the present invention is to provide a device as characterized above where beveled gear shaped blocks may interface in nonparallel planes simulating the action of beveled gears in a construction toy set.

Viewed from a first vantage point, it is an object of the present invention to provide a building block having a top surface, a bottom surface opposite said top surface and a plurality of side surfaces, said top surface being equipped with a plurality of circular posts of equal diameter and length extending upwardly from said top surface in a plurality of linear rows which extend from a center of said top surface, said top surface also being equipped with a plurality of vanes where each said vane is a rectangular projection radiating outward from said center of said top surface, said bottom surface being equipped with attachment means whereby multiple blocks are interconnectable via said posts and said attachment means.

Viewed from a second vantage point, is is an object of the present invention to provide a toy construction set of distinct blocks comprising in combination a plurality of primary blocks having a top surface, a bottom surface and side surfaces; said top surface having an attachment means and said bottom surface having an attachment means which complements said top surface attachment means allowing said top surface of one of said primary blocks to connect to said bottom surface of another of said primary blocks, and said side surfaces having either a first attachment means or a second attachment means which are complemental to each other or else having a third attachment means or a fourth attachment means complemental to each other allowing one said side surface of one said primary block with said first attachment means, or said third attachment means to connect with another said side surface of another said primary block with the said second attachment means, or said fourth attachment means and a plurality of gear blocks having a top surface, a bottom surface and a circular side surface; said top surface having an attachment means and said side surface having an interfacing means allowing one said gear block to tangentially contact another said gear block such that when one said gear block rotates another said gear block may also be rotated; whereby a combination of said blocks may be created in a variety of interesting and educational configurations.

Viewed from a third vantage point, it is an object of the present invention to provide a toy gear set for educating children in the function of mechanical mechanisms comprising in combination a plurality of gear blocks with a hub on a bottom surface, teeth on a side surface and a driving block attachment means on a top surface, a plurality of driving blocks capable of fastening to each other with a plurality of orifices and prominences or projections and channels on a plurality of side surfaces thereof, said orifices dimensioned to support said hubs of said gear blocks allowing rotation of said gears without translation, a plurality of said driving blocks having a prominence on a side surface thereof dimensioned to connect to said driving attachment means on said gear top surface of said gear blocks while allowing free rotation thereon, and a plurality of wafer-like mounting blocks having a side surface attachment means allowing adjacent said wafer-like mounting blocks to be fastened together, said top surface having a cylindrical hole which penetrates through to the bottom surface, capable of supporting said hubs of said gear blocks; whereby said driving blocks may be combined together with said orifices and said prominences or said projections and said channels, said gear blocks may be combined with said mounting blocks through connection of said hubs with said orifices in a orientation where said teeth on said side surfaces of said gear blocks are tangential to each other and said driving blocks are connected to said top surface of said gear blocks, thereby allowing an input force applied to said toy gear set to cause rotation of each of said gear blocks within said toy gear set.

Viewed from a fourth vantage point, it is an object of the present invention to provide a construction toy comprised of a plurality of construction blocks having multiple facets, one said facet on each said block having a prominence projecting from said facet, said prominence including means to allow deflection of said prominence both centrally inwardly and outwardly, and means for securing said facet bearing said prominence to another said facet of another said block.

Viewed from a fifth vantage point, it is an object of the present invention to provide a construction toy comprising, in combination a plurality of construction blocks having multiple facets, one said facet on each said block including a plurality of posts projecting from said facet, said post including retention means circumscribing said post for fastening to another said facet of another said block.

Viewed from a sixth vantage point, it is an object of the present invention to provide a construction toy comprising in combination a plurality of construction blocks having multiple facets, including a gear block, one said facet on one said gear block having gear teeth with planar and orthogonal meshing means to mesh with gear teeth on another said gear block having similar meshing means.

Viewed from a seventh vantage point, it is an object of the present invention to provide a toy building block set including a primary building block comprising in combination a planar top wall, a planar bottom wall and a peripheral edge between said top and bottom walls, said top wall defining a first attachment surface, said bottom wall defining a second attachment surface, said first and second attachment surfaces defining complemental interconnecting contours of plural, centrally disposed, radially extending vanes of constant width centrally disposed on one said wall frictionally engageable within a series of complementally formed spaces on another said wall, said peripheral edge defines a third attachment means and a cylindrical hole in a center of said top and bottom surface which passes entirely through said primary block defines a fourth attachment means; and a secondary building block comprising in combination a planar top wall, a planar bottom wall and a peripheral edge between said top and bottom walls, said top wall having contours similar to that of said primary block top surface, said bottom wall having a cylindrical hub formed centrally thereon of complemental size and shape to said cylindrical hole of said primary block and said peripheral edge being circular in shape and having a plurality of gear teeth formed thereon; whereby a plurality of said primary blocks may be attached together along said peripheral edges utilizing said third attachment means and a plurality of said secondary blocks may be attached to said primary blocks by inserting said cylindrical hubs into said cylindrical holes of said primary blocks wherein said secondary blocks may freely rotate and causing said gear teeth of said secondary blocks to interface with each other such that when one said secondary block is rotated, other adjacent said secondary blocks will be caused to rotate, and wherein said second attachment surface of said primary blocks may connect to said first attachment surface of said top wall of said secondary blocks.

These and other objects will be made manifest when considering the following detailed description when taken in conjunction with the appended drawing figures.

BRIEF OF THE DRAWINGS

DESCRIPTION OF THE PREFERRED EMBODIMENT

Figure 1:
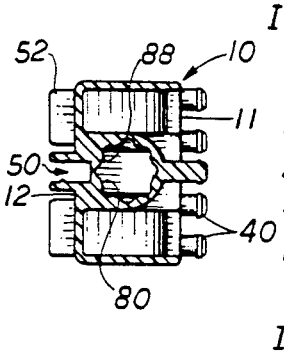
FIG. 1 is a sectional view taken along lines I—I of FIG. 2.

Referring now to the drawings wherein like numerals represent like parts throughout, reference numeral 10 is directed to a mounting block, shown in detail in FIGS. 1 through 9.

Figure 7:
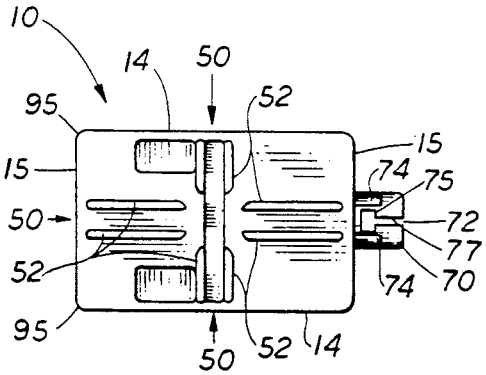
FIG. 7 is a bottom plan view of that which is shown in FIG. 2.
Figure 23:
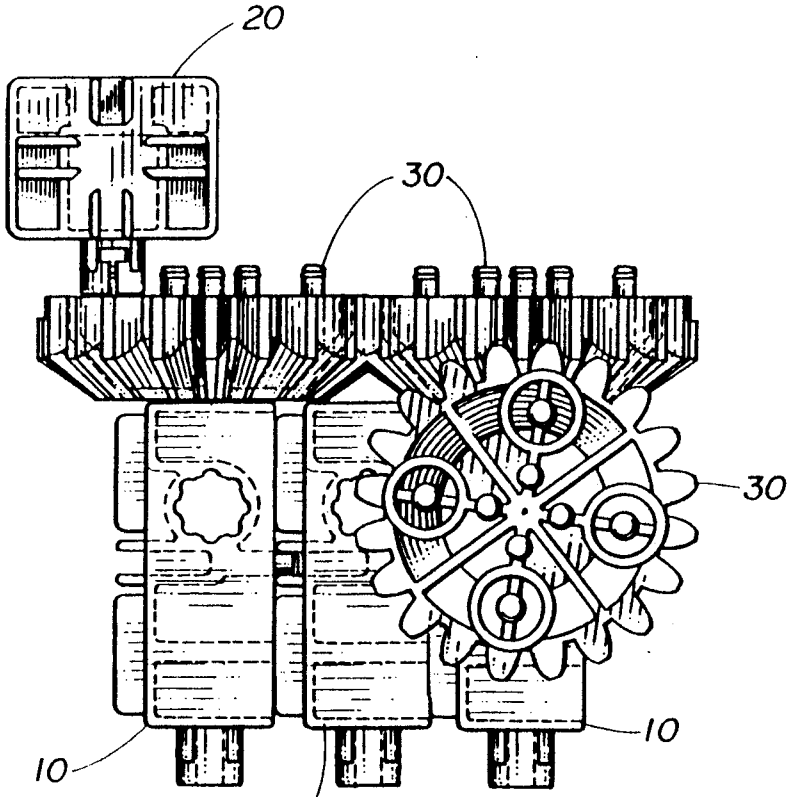
FIG. 23 is a plan view of a plurality of first, second and third blocks oriented and interconnected to simulate a mechanism combining beveled and planar gears.
Figure 22:
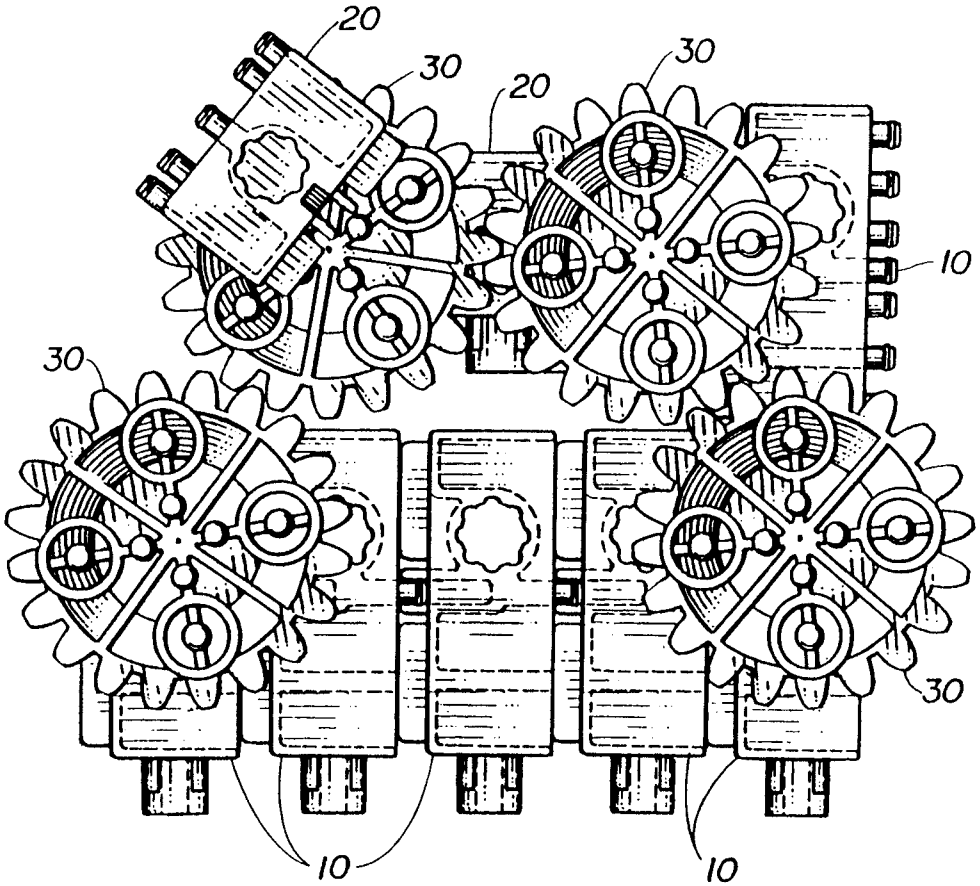
FIG. 22 is a plan view of a plurality of first, second and third blocks oriented and interconnected to simulate a planar gear mechanism.
Figure 32:
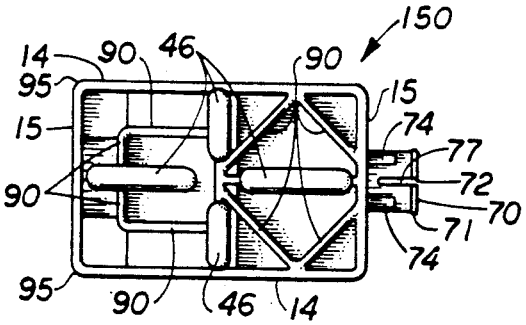
FIG. 32 is a top plan view of a modified version of that which is shown in FIG. 2.

In essence, the mounting block 10 is substantially a wafer-shaped construct having a top surface 11, a bottom surface 12 and a plurality of long side surfaces 14 and short side surfaces 15. The top surface 11 preferably has a plurality of posts 40 or vanes 46 (shown in FIG. 32). The bottom surface 12 has a plurality of channels 50 (FIG. 7). The side surfaces 14, 15 have either a prominence 70 or an orifice 80 positioned thereon. The posts 40 or vanes 46 are configured to fasten within the channels 50 and the prominences 70 are configured to fasten within the orifices 80 allowing a plurality of mounting blocks 10 to be attached together in a variety of ways, as shown in FIG. 22 and FIG. 23.

More particularly, the mounting block 10 includes a top surface 11 and a bottom surface 12 which respectively define first and second attachment surfaces. These attachment surfaces are complemental, allowing a plurality of mounting blocks 10 to be connected top-to-bottom in a series.

Figure 8:
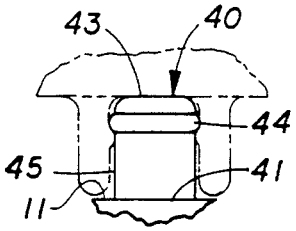
FIG. 8 is a front view detail of a portion of the apparatus.

The attachment means of the top surface 11 preferably includes a plurality of posts 40, shown in detail in FIG. 8, configured in rows 42 that radiate outwardly from a center of the top surface 11. The posts 40 may be configured in other functional patterns as well, such as that shown in FIG. 41 and FIG. 50. Each post 40 is preferably a substantially cylindrical construct fixedly attached on a first flat end 41 to the top surface 11 and extending upwardly perpendicular to the top surface 11. Alternatively, the posts 40 can be square or some other shape in cross-section. Each post 40 is of similar size and each row 42 is substantially linear, such that any flat surface placed against side walls 45 of the posts 40 may have a point of tangency with each of the posts 40 in the row 42.

An alternative top surface attachment means, shown in FIGS. 32 through 35 replaces the rows 42 of posts 40 with linear vanes 46 of cross-section similar to that of the posts 40. Between the vanes 46 singular posts 40 may be positioned. Some of the vanes 46 are of greater height than other vanes 46.

Preferably, each post 40 has a toroidal flair 44 circumscribing the side wall 45 near a second flat end 43, as shown in detail in FIG. 8. The toroidal flair 44 lies in a plane parallel to the top surface 11.

Also on the top surface 11, linear webbing 90 is formed in a variety of positions beneath the top surface 11. A top edge of the linear webbing 90 conforms to a plane coextensive with the top surface 11 and defining the exact location of the top surface 11. The linear webbing 90 provides added structural strength to the mounting blocks 10, reduces the volume of plastic used in manufacture, shortens the plastic cycle time in molding and helps define the top surface 11.

Figure 9:
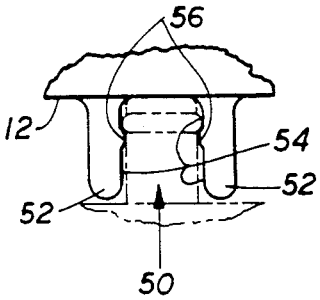
FIG. 9 is a front view detail of another portion of the apparatus.
Figure 42:
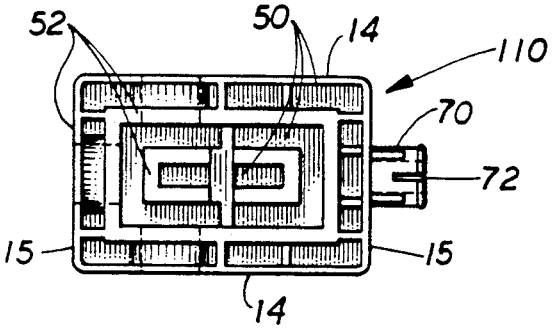
FIG. 42 is a bottom plan view of a modified version of that which is shown in FIG. 7.
Figure 51:
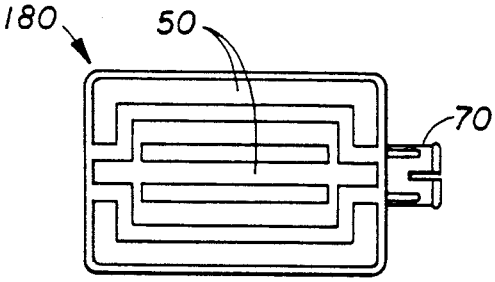
FIG. 51 is a bottom plan view of a modified version of that which is shown in FIG. 42.

The attachment means of the bottom surface 12 includes a plurality of channels 50, shown in detail in FIG. 9, that preferably radiate outwardly from a center of the bottom surface 12. Alternatively, the channels 50 may circumscribe the bottom surface 12 in a concentric pattern, shown in FIG. 42 and FIG. 51. Each of the channels 50 is formed from a pair of parallel walls 52 which are preferably rectangular plates which extend downward orthogonally from said bottom surface 12. Each wall 52 has an inside surface 54 which faces the opposite wall of the pair. A ledge 56 can be fixedly attached to each of the inside surfaces 54. The ledge 56 is a linear formation of uniform thickness and uniform distance from the bottom surface 12, which extends longitudinally along the entirety of the inside surface 54.

Figure 33:
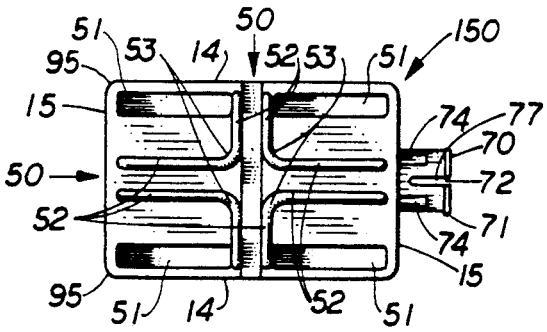
FIG. 33 is a bottom plan view of a modified version of that which is shown in FIG. 7.

In an alternative embodiment, each of the parallel walls 52 can connect through a curved transition 53, shown in FIG. 33, to an adjacent wall 52 from outside the pair of parallel walls 52 which is not parallel. The channels 50 extend into the bottom surface 12 to accommodate the extended length of the vanes 46. Additionally, recesses 51 can be formed on the bottom surface 12 parallel to long side surfaces 14. The recesses 51 are similar in width to the channels 50 and receive the vanes 46 or rows 42 of posts 40.

The ledge 56 is located a distance from the bottom surface 12 equal to a distance from the toroidal flair 44 to the second flat end 43 of the post 40. The walls 52 of the channel 50 are a distance apart substantially equal to the width of the posts 40 or the width of the vanes 46. Therefore, when two mounting blocks 10 are oriented with a top surface 11 and bottom surface 12 coming into contact, the posts 40 or vanes 46 will detachably attach securely within the channels 50 with the toroidal flair 44 directly above and adjacent to the ledge 56, shown in FIGS. 22, 23 and 25; and shown in phantom in FIGS. 8 and 9.

Figure 2:
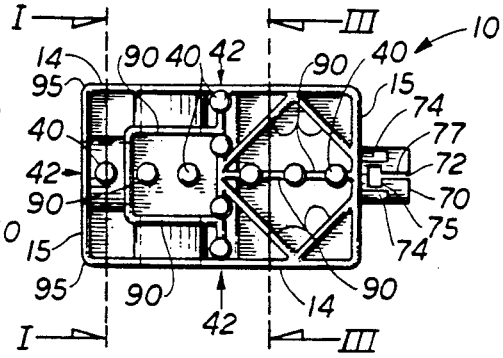
FIG. 2 is a top plan view of a first block of the apparatus according to one form of the invention.
Figure 3:
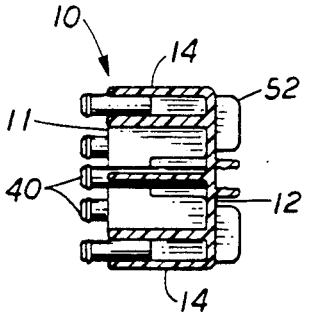
FIG. 3 is a sectional view taken along lines III—III of FIG. 2.
Figure 4:
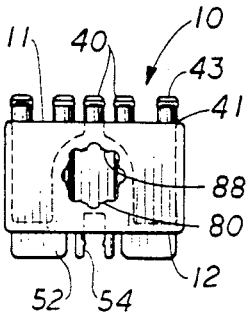
FIG. 4 is a left side view of that which is shown in FIG. 2.
Figure 5:
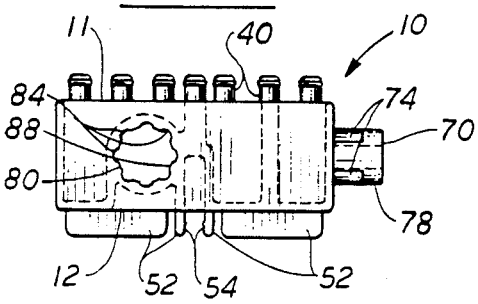
FIG. 5 is a front view of that which is shown in FIG. 2.

Preferably, the mounting blocks 10 are of rectangular cross section when viewed from above the top surface 11, as shown in FIG. 2, having two long side surfaces 14 and two short side surfaces 15. Preferably, the mounting blocks 10 have four rows 42 of posts 40 with each row 42 being oriented orthogonal to a side surface 14, 15. The rows 42 which are perpendicular to short side surfaces 15 have three posts 40 in each row 42 and the rows 42 perpendicular to long side surfaces 14 have two posts 40 in each row 42. Each row 42 is replaceable by a vane 46.

Figure 34:
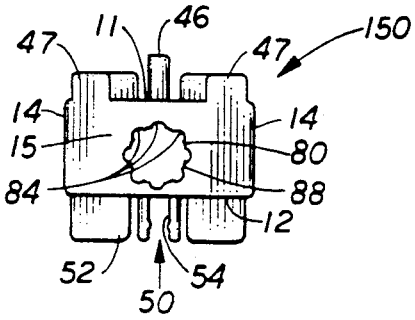
FIG. 34 is a left side view of a modified version of that which is shown in FIG. 4.
Figure 35:
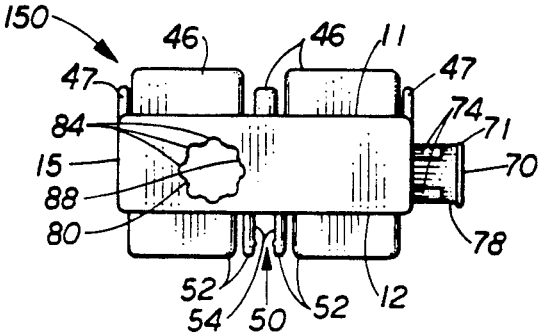
FIG. 35 is a front view of a modified version of that which is shown in FIG. 5.

In an alternative embodiment, each edge between the top surface 11 and the short side surfaces 15 has two tabs 47, shown in FIGS. 34 and 35, which extend perpendicularly away from the top surface 11. The tabs 47 are rectangular plates which extend no farther from the top surface 11 as the posts 40 or vanes 46. The tabs 47 may fit within a channel 50 of an adjoining bottom surface 12 of another mounting block 10 which is staggered in relationship to the other mounting blocks 10. The tabs 47 provide additional stability to a group of stacked mounting blocks 10.

Figure 41:
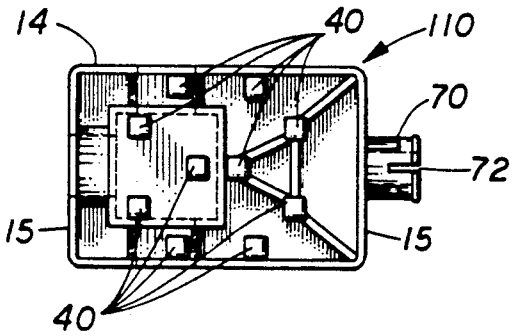
FIG. 41 is a top plan view of a modified version of that which is shown in FIG. 2.
Figure 50:
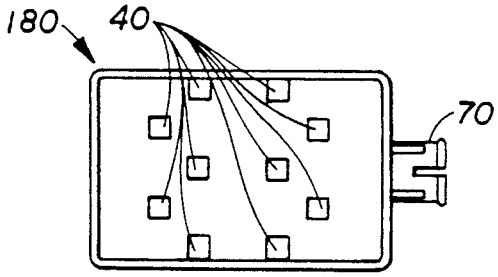
FIG. 50 is a top plan view of a modified version of that which is shown in FIG. 41.

Preferably, the bottom surface 12 is configured with four channels 50, each channel 50 being perpendicular to a side surface 14, 15. In this configuration, the rows 42 of posts 40 or vanes 46 are aligned on the top surface 11 directly above the channels 50 on the bottom surface 12. In an alternative embodiment, the channels 40 are oriented circumferentially around the bottom surface 12 in concentric rectangles. This configuration, shown in FIG. 42 and FIG. 51, facilitates connection to a top surface 11 with posts 42 oriented as shown in FIG. 41 and FIG. 50.

Preferably, the posts 40 are located a uniform distance apart from each other. This allows one mounting block 10 to connect to another mounting block 10 in various rotationally distinct top-to-bottom configurations. Some variations are shown in detail in FIGS. 25 through 31. When configured in this way, posts 40 from the same row 42 may even attach within separate channels 50 of an adjoining mounting block 10. A mounting block 10 having vanes 46 may also connect to another mounting block 10 in various rotationally distinct top-to-bottom configurations. A mounting block 10 having posts 40 in a non linear pattern, as shown in FIG. 41 and FIG. 50, may also connect to another mounting block 10 in various rotationally distinct top-to-bottom configurations.

Figure 10:
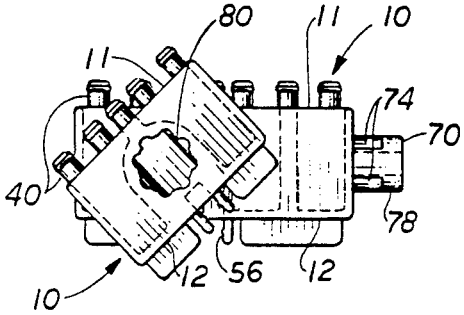
FIG. 10 is a front view of one of the first blocks of the apparatus with another first block connected thereto.
Figure 11:
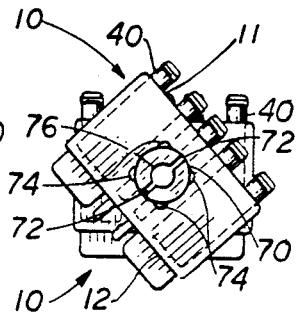
FIG. 11 is a block view of one of the first blocks of the apparatus with another first block left side connected thereto.
Figure 12:
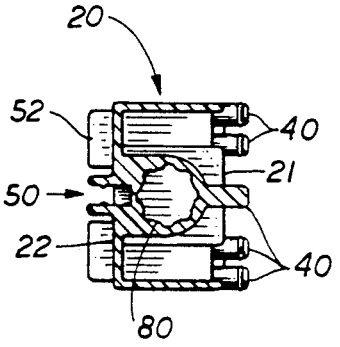
FIG. 12 is a sectional view taken along lines XII—XII of FIG. 13.

Each of the side surfaces 14, 15 of the mounting blocks 10 is equipped with either a prominence 70 or an orifice 80. The prominence 70 and the orifice 80 are of complemental shape allowing the prominence 70 to attach within the orifice 80, as shown in FIGS. 10 and 11, thereby linking separate mounting blocks 10 through their adjoining side surfaces 14, 15.

The prominence 70 is substantially a cylindrical construct having a hollow core 76. The prominence 70 may extend outwardly orthogonally from either side surface 14, 15. The prominence 70 has a curved outer side wall 78 with a plurality of ribs 74 fixedly attached thereto extending along the side wall 78 in a direction perpendicular to the side surface 14, 15. In one embodiment, shown in FIGS. 33 through 35, the prominence 70 has a lip 71 extending radially outwardly from the outer edge of the prominence 70. The lip 71 holds the prominence 70 within the orifice 80.

Figure 6:
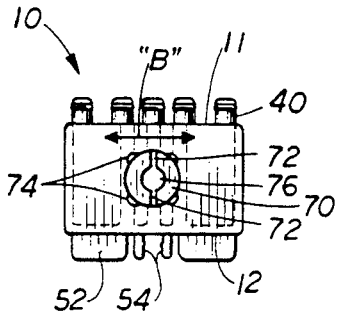
FIG. 6 is a right side view of that which is shown in FIG. 2.

A plurality of slits 72 are formed in the prominence 70 extending from the hollow core 76 to the side wall 78 and completely bisecting the prominence 70 in a plane perpendicular to the side surface 14, 15, as most clearly shown in FIG. 6. The hollow core 76 has an inner region 75 (FIG. 2) adjacent to the side surface 14, 15 and an outer region 77 outward from the inner region 75. The inner region 75 of the core 76 has a width greater than the width of the outer region 77 of the core 76. The core 76 is of substantially similar diameter as is the diameter of the post 40 of the top surface 11.

Two mounting blocks 10 may be connected by inserting the post 40 of the top surface 11 of one mounting block 10 into the core 76 of the side surface 14, 15 of another mounting block 10. The toroidal flair 44 of the post 40 can insert within the inner region 75 by deflecting the prominence along arrow "B". This allows the post 40 and attached mounting block 10 to rotate relative to the core 76 of the prominence 70 and attached mounting block 10.

The orifice 80 is substantially a cylindrical recess which extends inwardly orthogonally from the side surface 14, 15. The orifice 80 has a curved side wall 88 with a plurality of undulations 84 formed thereupon and oriented to extend in a direction perpendicular to the side surface 14, 15. Each undulation 84 extends from the side surface 14, 15, inward toward a center of the mounting block 10. A generally circular, yet serpentine, cross-sectioned recess is thus formed.

Therefore, when two mounting blocks 10 are oriented with the side surfaces 14, 15 adjacent to each other, the prominence 70 in the one side surface 14, 15 may fit within the orifice 80 in the other side surface 14, 15 by deflecting the prominence 70 in the direction opposite from arrow "B". The ribs 74 of the prominence 70 fit complementally with the undulations 84 of the orifice 80 restricting the two mounting blocks 10 from relative rotation. Also, the lip 71 of the prominence 70 holds the prominence 70 within the orifice 80.

Because each rib 74 is of uniform width and uniform distance from adjacent ribs 74 and because each undulation 84 is of uniform width and uniform distance from adjacent undulations 84, the side surfaces 14, 15 of adjoining mounting blocks 10 may connect through the prominence 70 and orifice 80 in a variety of different orientations by rotation of one of the mounting blocks 10 relative to another of the mounting blocks 10 about an axis co-linear with a center axis of the prominence 70 and the orifice 80, as shown in FIGS. 10 and 11.

Preferably, one of the short side surfaces 15 of the mounting block 10 is equipped with a prominence 70 located at the center of the short side surface 15. The other three side surfaces 14, 15 are all equipped with orifices 80. On the short side surface 15, the orifice 80 is centrally located, but on the long side surfaces 14 the orifices 80 are located nearest to the short side surface 15 having the orifice 80. In this way, all of the orifices 80 are located an equal distance from corners between the side surfaces 14, 15 which have orifices 80, for reasons to be explained later.

Figure 18:
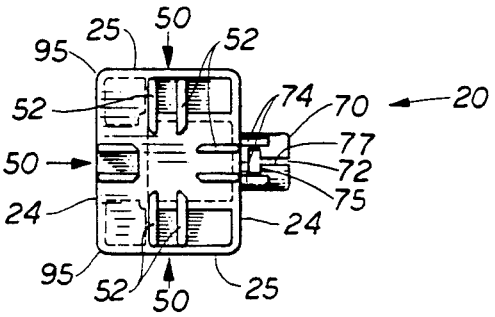
FIG. 18 is a bottom plan view of that which is shown in FIG. 13.

Reference numeral 20 is directed to a driving block, shown in detail in figures 12 through 18. In essence, the driving block 20 is substantially a wafer-shaped construct having a top surface 21, a bottom surface 22 and a plurality of side surfaces 24, 25. Similar to the mounting block 10 of FIGS. 1-11, the top surface 21 has a plurality of posts 40. The bottom surface 22 has a plurality of channels 50 (FIG. 18). The side surfaces 24, 25 have either a prominence 70 or an orifice 80 on each side surface 24, 25. The posts 40 are configured to fasten within the channels 50 and the prominences 70 are configured to fasten within the orifices 80 allowing a plurality of driving blocks 20 to be attached together in a variety of ways. In an alternative embodiment, rows 42 of posts 40 may be replaced with vanes 46.

More particularly, the driving block 20 includes a top surface 21 and bottom surface 22 which respectively define first and second attachment surfaces. These attachment surfaces are complemental allowing a plurality of driving blocks 20 to be connected top-to-bottom in a series.

Figure 52:
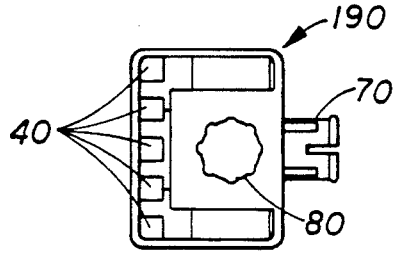
FIG. 52 is a top plan view of a modified version of that which is shown in FIG. 44.

The attachment means of the top surface 21 is a plurality of posts 40, shown in detail in FIG. 8, preferably configured in rows 42 that radiate outward from a center of the top surface 21. Alternatively, the posts 40 may be oriented in a pattern such as that shown in FIG. 44 and FIG. 52. Each post 40 is preferably a substantially cylindrical construct fixedly attached on a first flat end 41 to the top surface 21 and extending outwardly perpendicular to the top surface 21. Alternatively, the posts may have a non circular cross-section. The geometry of the posts 40 is described more specifically hereinabove in connection with the description of the mounting blocks 10. In an alternative embodiment, the rows 42 of posts 40 may be replaced with vanes 46.

Figure 13:
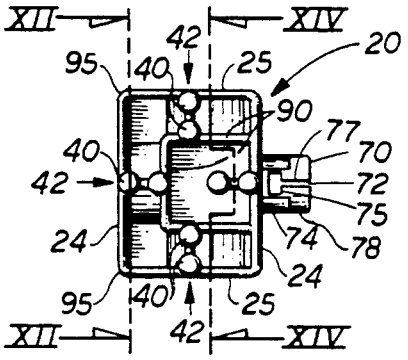
FIG. 13 is a top plan view of a second block of the apparatus according to one form of the invention.
Figure 14:
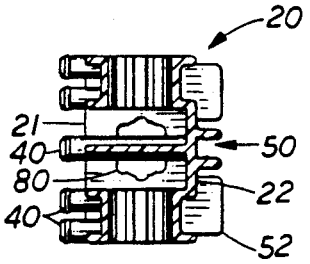
FIG. 14 is a sectional view taken along lines XIV—XIV of FIG. 13.
Figure 15:
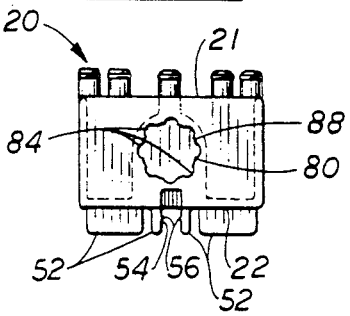
FIG. 15 is a left side view of that which is shown in FIG. 13.
Figure 16:
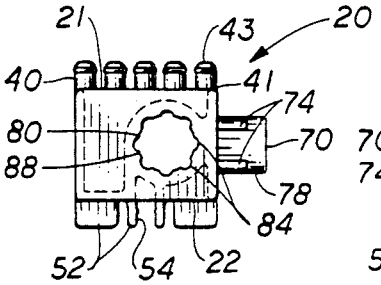
FIG. 16 is a front view of that which is shown in FIG. 13.
Figure 17:
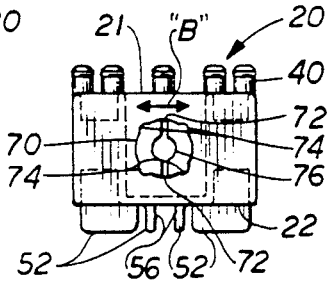
FIG. 17 is a right side view of that which is shown in FIG. 13.

Also on the top surface 21, linear webbing 90 is formed in a variety of positions beneath the top surface 21, shown in FIG. 13. A top edge of the linear webbing 90 conforms to a plane coextensive with the top surface 21 in defining the exact location of the top surface 21. The linear webbing 90 provides added structural strength to the driving blocks 20 and helps define the top surface 21.

Figure 45:
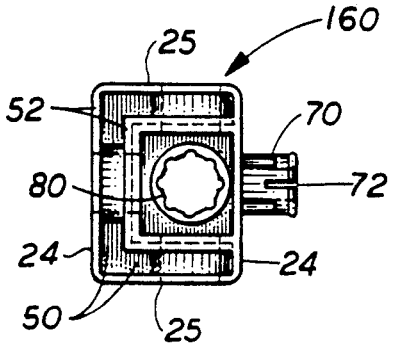
FIG. 45 is a bottom plan view of a modified version of that which is shown in FIG. 18.
Figure 43:
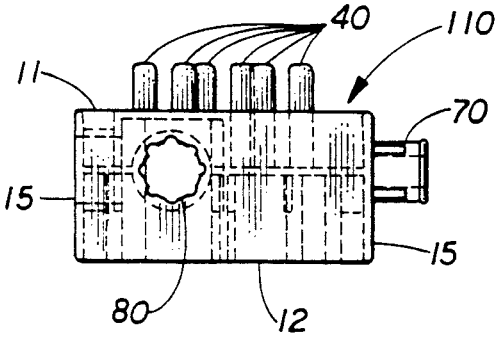
FIG. 43 is a front view of a modified version of that which is shown in FIG. 5.
Figure 46:
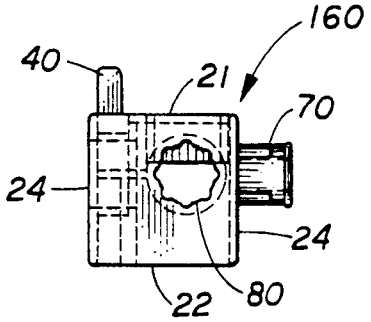
FIG. 46 is a front view of a modified version of that which is shown in FIG. 16.
Figure 53:
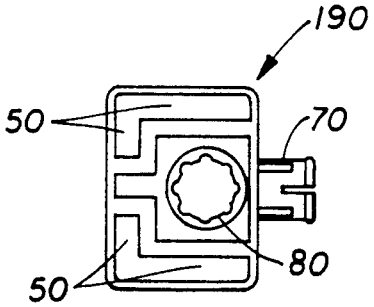
FIG. 53 is a bottom plan view of a modified version of that which is shown in FIG. 45.

The attachment means of the bottom surface 22 is a plurality of channels 50, also shown in detail in FIG. 9, that preferably radiate outward from a center of the bottom surface 22. Alternatively, the channels 50 may partially circumscribe the surface 22 as shown in FIG. 45 and FIG. 53. The geometry of the channels 50 is described more specifically hereinabove in connection with the description of the mounting blocks 10.

Preferably, a ledge 56, shown in detail in FIG. 9, is located a distance from the bottom surface 22 equal to a distance from a toroidal flair 44, shown in detail in FIG. 8, to the second flat end 43 of the post 40. Walls 52 of the channel 50 are a distance apart substantially equal to the width of the posts 40 and the width of the vanes 46. Therefore, when two driving blocks 20 are oriented with a top surface 21 and a bottom surface 22 coming into contact, the posts 40 (or the vanes 46) will detachably attach securely within the channels 50 with the toroidal flair 44 directly above and adjacent to the ledge 56.

Preferably the driving blocks 20 are of rectangular cross-section when viewed from above the top surface 21, as shown in FIG. 13, having two long side surfaces 24 and two short side surfaces 25. Preferably, the driving blocks 20 have four rows 42 of posts 40 with each row 42 being oriented orthogonal to a side surface 24, 25. The rows 42 which are perpendicular to short side surfaces 25 have two posts in each row 42 and the rows 42 perpendicular to long side surfaces 24 have two posts 40 in each row 42. Preferably, the bottom surface 22 is configured with four channels 50, each channel 50 being perpendicular to a side surface 24, 25. In this configuration, the posts 40 are aligned on the top surface 21 directly above the channels 50 on the bottom surface 22.

The posts 40 are located a distance apart from each other which allows a driving block 20 to connect to another driving block 20 in various rotationally distinct top-to-bottom configurations. When configured in this way, posts 40 from the same row 42 may attach within separate channels 50 of an adjoining driving block 20. In an alternative embodiment, shown in FIG. 44 and FIG. 52, only one row 42 of posts 40 extends from one side of the bottom surface 22. When configured in this way, the posts 40 fit within the channel 50 on the top surface 21, shown in FIG. 45 and FIG. 53.

Each of the side surfaces 24, 25 of the driving blocks 20 is equipped with either a prominence 70 or an orifice 80. The prominence 70 and the orifice 80 are of complemental shape allowing the prominence 70 to attach within the orifice 80, thereby linking separate driving blocks 20 through their adjoining side walls 24, 25. The geometry of the prominences 70 is described more specifically hereinabove in connection with the description of the mounting blocks 10. The geometry of the orifices 80 is described more specifically hereinabove in connection with the description of the mounting blocks 10.

Figure 44:
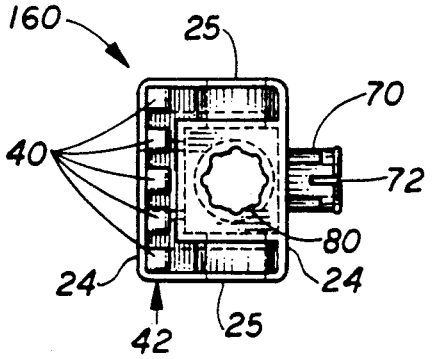
FIG. 44 is a top plan view of a modified version of that which is shown in FIG. 13.

An orifice 80 can be located on the top surface 21 as shown in FIG. 44. This orientation allows the top surface 21 of the driving block 20 to connect with side surfaces 24, 25 of another driving block 20 or to side surfaces 14, 15 of a mounting block 10.

When two driving blocks 20 are oriented with side surfaces 24, 25 adjacent to each other, the prominence 70 in the one side surface 24, 25 may fit within the orifice 80 in the other side surface 24, 25 or the top surface 21. The ribs 74 of the prominence 70 fit complementally with the undulations 84 of the orifice 80 restricting the two driving blocks 20 from relative rotation. Because each rib 74 is of uniform width and uniform distance from adjacent ribs 74 and because each undulation 84 is of uniform width and uniform distance from adjacent undulations 84, the side surfaces 24, 25 of adjoining driving blocks 20 may connect through the prominence 70 and orifice 80 in a variety of different orientations by rotation of one of the driving blocks 20 relative to another of the driving blocks 20 about an axis co-linear with a center of the prominence 70 and the orifice 80.

Preferably, one of the long side surfaces 24 of the driving block 20 is equipped with a prominence 70 located at the center of the long side surface 24. The other three side surfaces 24, 25 are all equipped with orifices 80. On the long side surface 24 the orifice 80 is centrally located, but on the short side surfaces 25 the orifices 80 may be located nearest to the long side surface 24 having the prominence 70. In this way, all of the orifices 80 are located an equal distance from corners between the side surfaces 24, 25 which have orifices 80, for reasons to be explained later.

The driving block 20 and mounting block 10 are of substantially similar design except for the difference in proportional length between the short side surfaces 25 and the long side surfaces 14. Thus, the two blocks 10, 20 may function similarly in many ways.

Figure 19:
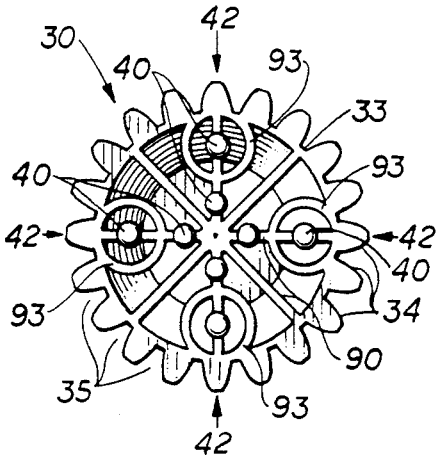
FIG. 19 is a top plan view of a third block of the apparatus according to one form of the invention.
Figure 20:
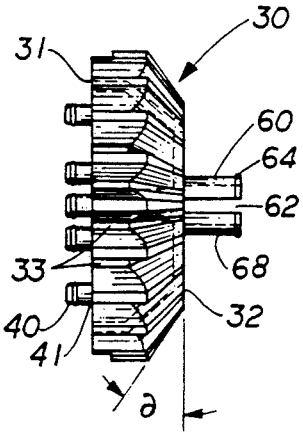
FIG. 20 is a right side view of that which is shown in FIG. 19.
Figure 21:
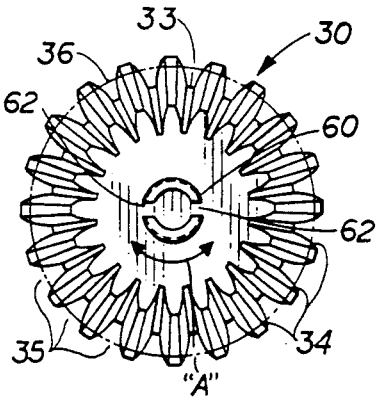
FIG. 21 is a bottom plan view of that which is shown in FIG. 19.
Figure 36:
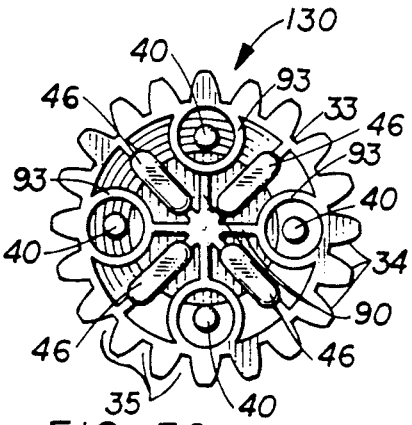
FIG. 36 is a top plan view of a modified version of that which is shown in FIG. 19.

Reference numeral 30 is directed to a gear block 30, shown in detail in figures 19 through 21. In essence, the gear block 30 is substantially a wafer-shaped construct having a top surface 31, a bottom surface 32 and a side surface 33. The top surface 31 has a plurality of posts 40 (or vanes 46 and posts 40 as shown in FIG. 36). The bottom surface 32 has a hub 60. The side surface 33 has a plurality of beveled gear teeth 34 fixedly attached thereto. The posts 40 (and vanes 46) are configured to fasten within the channels 50 of the mounting blocks 10 and the driving blocks 20. The hub 60 is configured to fasten within the orifices 80 of the mounting blocks 10 and the driving blocks 20 allowing a plurality of gear blocks 30 to be attached to mounting blocks 10 and driving blocks 20 in a variety of ways, some of which are shown in FIGS. 22 and 23.

More particularly, the gear block 30 includes a top surface 31 and a bottom surface 32 which respectively define first and second attachment surfaces.

Figure 47:
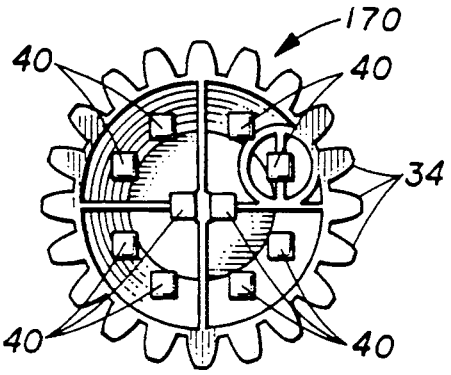
FIG. 47 is a top plan view of a modified version of that which is shown in FIG. 19.
Figure 48:
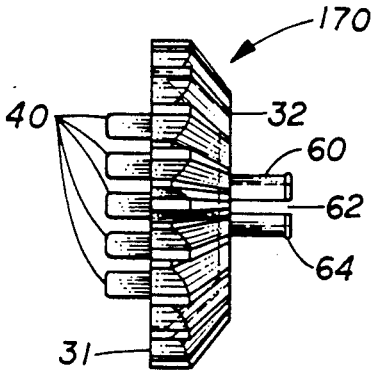
FIG. 48 is a right side view of a modified version of that which is shown in FIG. 20.
Figure 54:
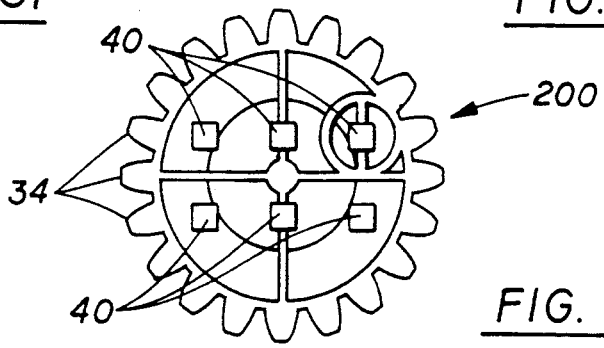
FIG. 54 is a top plan view of a modified version of that which is shown in FIG. 47.

The attachment means of the top surface 31 is a plurality of posts 40, shown in detail in FIG. 8, preferably configured in rows 42 that radiate outward from a center of the top surface 31. Each post 40 is a substantially cylindrical construct fixedly attached on a first flat end 41 to the top surface 31 and extending outwardly perpendicular to the top surface 31. The geometry of the posts 40 is described more specifically hereinabove in connection with the description of the mounting blocks 10. Alternatively, the posts 40 may be configured in a variety of patterns such as that shown in FIG. 47 and FIG. 54.

Figure 37:
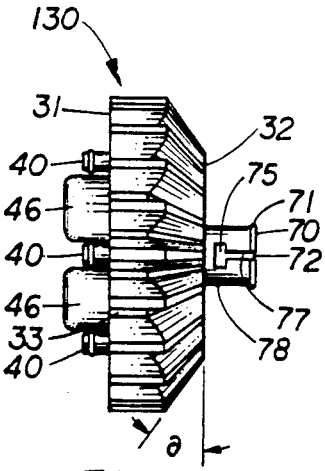
FIG. 37 is a right side view of a modified version of that which is shown in FIG. 20.
Figure 38:
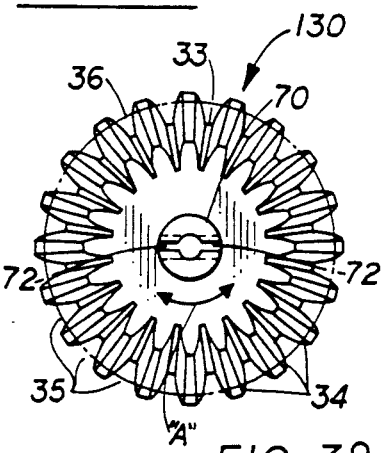
FIG. 38 is a bottom plan view of a modified version of that which is shown in FIG. 21.

The gear block 130 is an alternative embodiment of the gear block 30, shown in FIGS. 36 through 38, which involves replacing the rows 42 of posts 40 with a plurality of linear vanes 46. The vanes 46 are of similar cross-section to the posts 40 and thus function similarly within channels 50 of the mounting blocks 10 and driving blocks 20. Interposed between the vanes 46 are a plurality of single posts 40. The posts 40 may be used as connectors to apply rotation to the gear blocks 130, 30 as will be described below.

Preferably, the gear blocks 30 have four rows 42 of posts 40 with each row 42 being orthogonal to adjacent rows 42. Preferably, each row 42 has two posts 40.

Also on the top surface 31, radially extending linear webbing 90 is formed in a variety of positions beneath the top surface 31, as shown in FIG. 19. A top edge of the linear webbing 90 conforms to a plane coextensive with the top surface 31 and defining the exact location of the top surface 31. Also on said top surface 31, circular webbing 93 is formed beneath the top surface 31, as shown in FIG. 19. A top edge of the circular webbing 93 conforms to a plane coextensive with the top surface 31 and defining the exact location of the top surface 31.

The circular webbing 93 encircles each post 40 that is at an end of any of the rows 42 radially away from a center of the top surface 31. The circular webbing 93 also encircles posts 40 interposed between vanes 46. Each encircled post 40 is at the center of the circular webbing 93. The linear webbing 90 and circular webbing 93 provide added structural strength to the gear blocks 30 and help define the top surface 31. The circular webbing 93 also supports any connection to an encircled post 40 as shall be evident. Alternatively, the circular webbing 93 may be configured in a variety of patterns such as that shown in FIG. 47 and FIG. 54.

The attachment means of the bottom surface 32 is a hub 60. The hub 60 is a hollow cylindrical construct located in a center of the bottom surface 32 of the circular gear blocks 30. The hub 60 extends downward perpendicularly from the bottom surface 32. The hub 60 has a plurality of slits 62 formed in a side wall 68 of the hub 60 in a plane perpendicular to the bottom surface 32. A lip 64 is formed on an end of the hub 60 opposite the bottom surface 32 which extends radially outwardly from the side wall 68.

The hub 60 is of similar diameter and length to the prominence 70 of both the mounting blocks 10 and the driving blocks 20, allowing connections as shown in FIGS. 22 and 23. Thus the hub 60 may fit within the orifice 80 of the mounting blocks 10 or the driving blocks 20. The hub 60 may also attach over a post 40 if modified as shown in FIG. 38. The lip 64 of the hub 60 fits into the orifice 80 adjacent to the side surface 14, 15 or the side surface 24, 25. The side wall 88 of the orifice 80 is slightly shorter than the length of the hub 60. When the hub 60 is placed within the orifice 80 the lip 64 resides beyond the side wall 88, thus retaining the hub 60 within the orifice 80 in a way similar to that of the prominence 70. The hub 60 preferably does not have ribs 74 and so the hub 60 is free to rotate within the orifice 80 about arrow "A". In this manner, a gear block 30 may attach to a mounting block 10 or a driving block 20 in a manner allowing rotation but restricting axial translation.

The posts 40 are located a distance apart from each other which allows a mounting block 10 to connect to a gear block 30 in various rotationally distinct top-to-bottom configurations. When configured in this way, posts 40 from the same row 42 of the gear block 30 may attach within separate channels 50 of an adjoining mounting block 10.

The gear block 30 has a plurality of beveled gear teeth 34 fixedly attached to the side surface 33. Each tooth 34 extends radially outwardly perpendicular to the side surface 33. The teeth 34 are separated from each other by a uniform distance such that gaps 35 between the teeth 34 are similar in width to the width of the teeth 34. This allows adjacent gear blocks 30 to mesh in driving relation. Each tooth 34 is beveled between the side surface 33 and the bottom surface 32 at an angle $\partial$.

Each gear block 30 is of similar size and has teeth 34 of similar size such that two distinct gear blocks 30 may be placed adjacent to each other with the teeth 34 of the one gear block 30 fitting within the gap 35 of the other gear block 30. The two gear blocks 30 may interface in planes parallel to each other. They may also interface in two separate planes of the beveled gears 34. In this case, the angle between the two planes is equal to two times the angle $\partial$ of each beveled gear 34 of each connected gear block 30.

Figure 24:
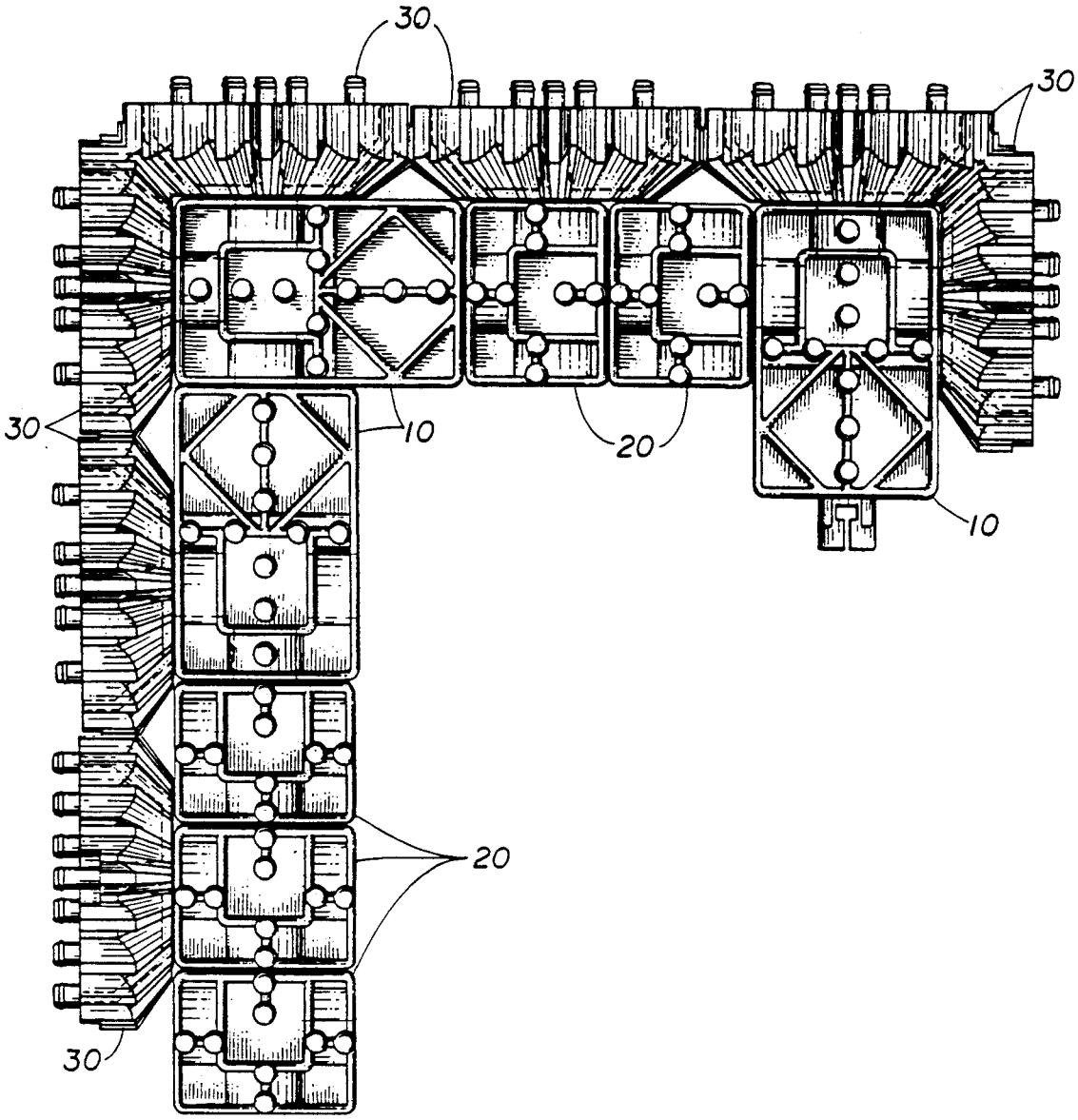
FIG. 24 is a plan view of a plurality of first, second and third blocks oriented and interconnected to simulate a mechanism combining beveled and planar gears.
Figure 25:
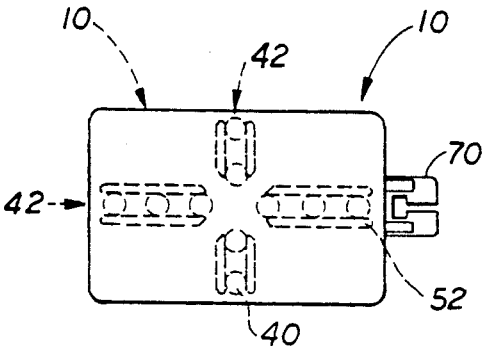
FIG. 25 is a top plan view showing the first blocks in an attached configuration.
Figure 26:
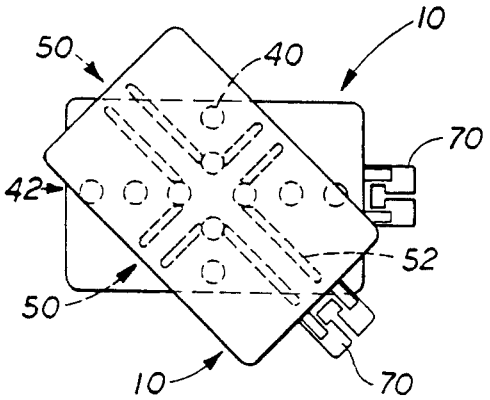
FIG. 26 is a top plan view showing the first blocks in another attached configuration.
Figure 27:
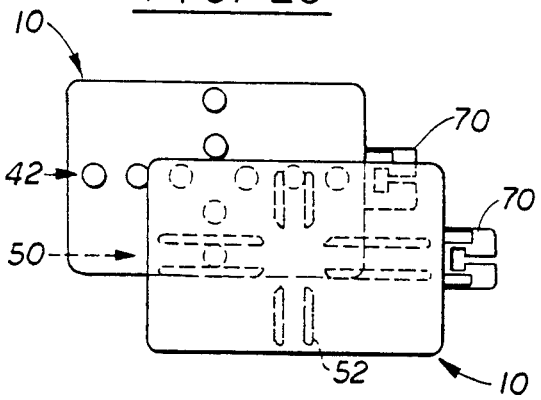
FIG. 27 is a top plan view showing the first blocks in another attached configuration.
Figure 28:
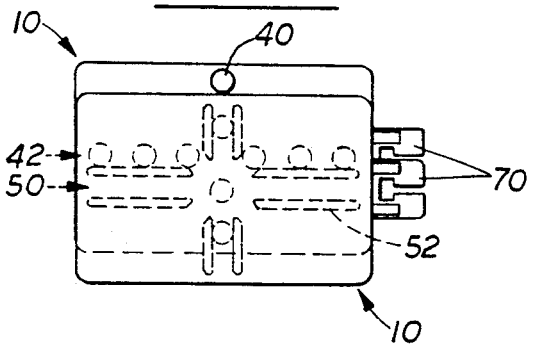
FIG. 28 is a top plan view showing the first blocks in another attached configuration.
Figure 29:
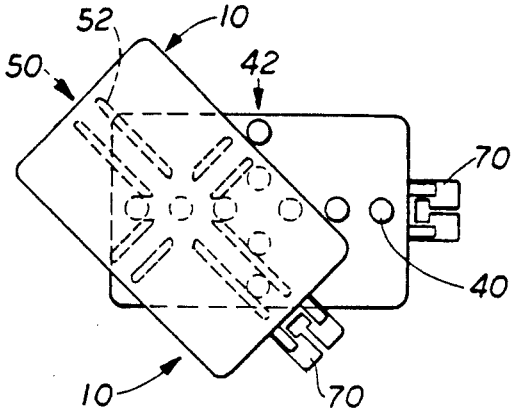
FIG. 29 is a top plan view showing the first blocks in another attached configuration.
Figure 30:
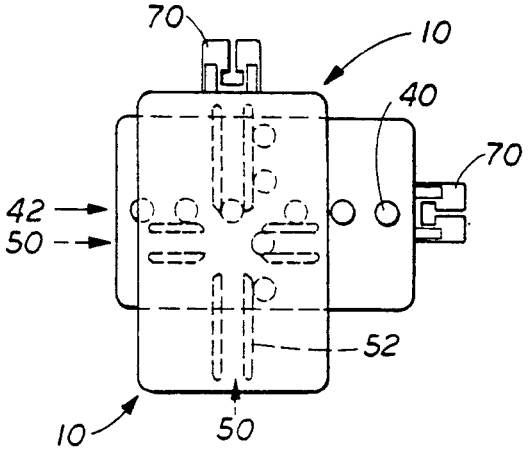
FIG. 30 is a top plan view showing the first blocks in another attached configuration.
Figure 31:
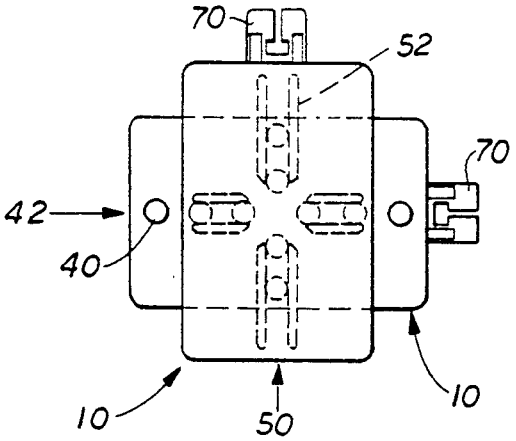
FIG. 31 is a top plan view showing the first blocks in another attached configuration.

Preferably, the beveled angle $\partial$ will be 45° causing the two planes to be orthogonal. This allows the two gears 30 to interface at right angles to each other, as shown in FIG. 24 and FIG. 25. When one interfacing gear block 30 is rotated, the other interfacing gear block 30 is caused to rotate. This action helps the user of the invention to better grasp the function of many mechanical devices.

The interaction of the various blocks 10, 20 and 30 can now best be appreciated in view of the previously described structure. The length of the long side surface 14 of the mounting block 10 is substantially equal to the diameter of a pitch circle 36 (FIG. 21) of the gear block 30. When two mounting blocks 10 are connected to each other along complemental short side surfaces 15, two orifices 80, one from each mounting block 10, are arranged capable of receiving two hubs 60 from two distinct gear blocks 30. The teeth 34 of the gear blocks 30 then interface together in an operative orientation. Furthermore, additional mounting blocks 10 and gear blocks 30 may be added to the first set of mounting blocks 10 and gear blocks 30 along both side surfaces 14, 15, top surfaces 11 and bottom surfaces 12 allowing gear blocks 30 mounted in orifices 80 to interact in a variety of ways including those shown in FIGS. 22, 23.

Also, three driving blocks 20 may be connected along side surfaces 24, 25 allowing two gear blocks 30 with hubs 60 mounted in orifices 80 of the two outside driving blocks 20 to interact in a fashion similar to that of a pair of mounting blocks 10.

Preferably, the distance from the orifice 80 located on the long side 14 to a corner 95 (e.g. FIG. 2 or 13) adjoining the short side surface 15 with the orifice 80 is equal to the distance from the orifice 80 of the short side surface 15 to the corner 95. Preferably, this distance between orifice 80 and corner 95 is equal to the radius of the pitch circle 36 (FIG. 21) along the bottom surface 32. This allows two gear blocks 30 to fit into orifices 80 on adjacent side surfaces 14, 15 of the mounting blocks 10 in a way allowing the teeth 34 of the gear blocks 30 to interface. In this configuration, two gear blocks 30 may interface while at right angles to each other, approximating the action of a beveled gear pair, as shown in FIG. 23.

The core 76 of the prominence 70 of the driving block 20 or the mounting block 10 or the hub 60 of the gear block 30 may be attached over the encircled post 40 on the top surface 31 of the gear block 30, as shown in FIG. 23. In this configuration, the driving block 20 or the mounting block 10 or the gear block 30 may act as an input driver for an assemblage of interfacing gear blocks 30. The driving block 20 or the mounting block 10 or the gear block 30 can rotate relative to the post 40 of the gear block 30, allowing a user to firmly grasp the driving block 20 or mounting block 10 or gear block 30 while rotating the gear blocks 30. The circular webbing 93 which surrounds the posts 40 of the gear block 30 helps hold the prominence 70 of the driving block 20 or the mounting block 10 in place while the gear block 30 is rotated.

A plurality of gear blocks 30 may be connected to a driving block 20 by location of hubs 60 within adjacent orifices 80 on the side surfaces 24, 25 and the top surface 22 of the driving block 20. This orientation allows the gear blocks 30 to attach to an assemblage of mounting blocks 10 and driving blocks 20 in more ways than otherwise possible.

Referring now to FIGS. 32 through 38, a mounting block 150 and a gear block 130 are shown. The mounting block 150 is similar to the mounting block 10 except that various attachment means of the mounting block 150 have been modified to include alternative embodiments described above. The mounting block 150 interacts with the gear block 130 in a way similar to the interaction of the mounting block 10 with the gear block 30.

Referring now to FIGS. 42 through 47, a mounting block 110, a driving block 160 and a gear block 170 are shown. These blocks 110, 160, 170 are similar to their counterpart blocks 10, 20, 30, except that various attachment means have been modified and other minor changes have been made according to alternative embodiments described hereinabove.

Figure 49:
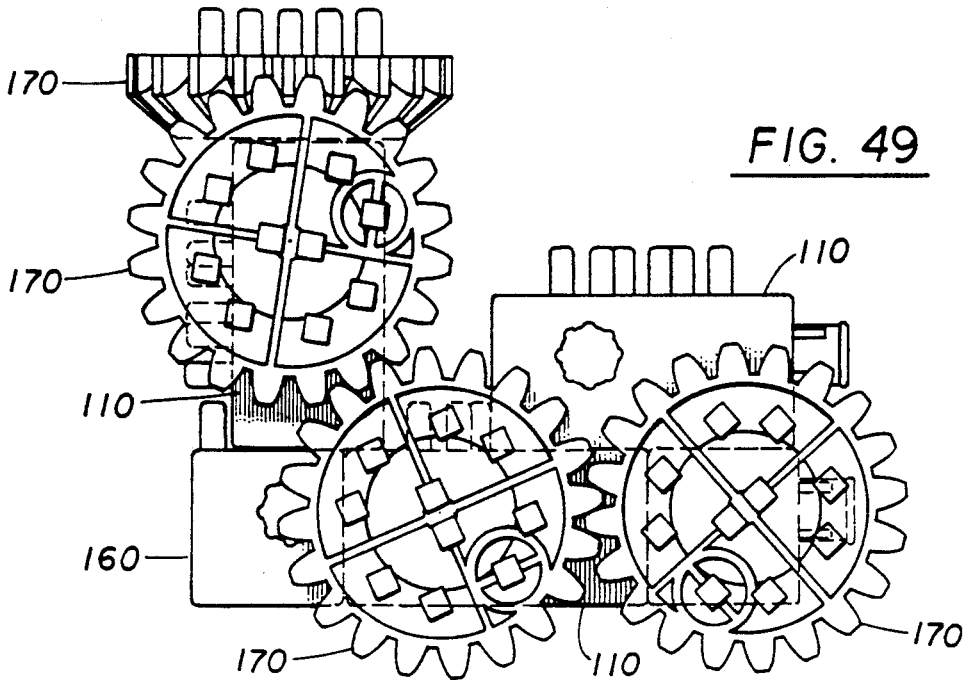
FIG. 49 is a plan view of a plurality of first, second and third blocks of an alternative form of the invention interconnected to simulate a mechanism combining beveled and planar gears.

The blocks 110, 160, 170 interact with each other, as shown in FIG. 49, in a way similar to the interaction of the blocks 10, 20, 30. However, the orifice 80 on the top surface 21 of the driving block 160 allows the blocks 110, 160 to connect in a way allowing positioning of the orifices 80 of the blocks 110, 160 in three mutually perpendicular planes. Thus, gear blocks 170 connected to the blocks 110, 160 can interface with each other while rotating in three mutually perpendicular planes simultaneously.

Referring now to FIGS. 50 through 54, alternative embodiments of the blocks 110, 160, 170 are shown A mounting block 180 shows an alternative post 40 array and an alternative channel 50 configuration. A driving block 190 shows an alternative post 40 array and an alternative channel 50 configuration. A gear block 200 shows an alternative post 40 configuration conformable to the channel 50 configuration of the mounting block 180 and driving block 190.

Figure 39:
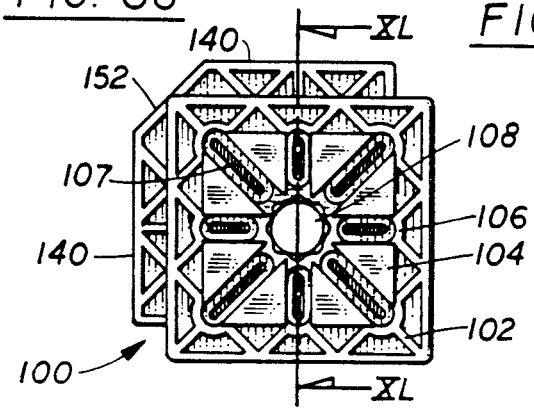
FIG. 39 is a top plan view of a fourth wafer-like block of the apparatus according to one form of the invention.
Figure 40:
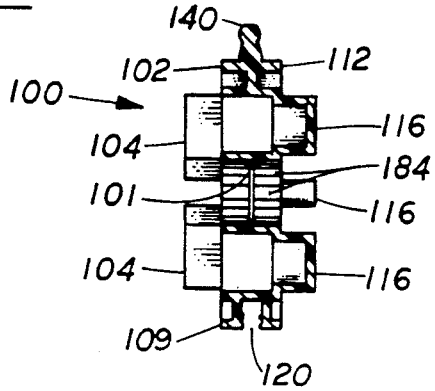
FIG. 40 is a sectional view taken along lines XL—XL of FIG. 39.

Referring now to FIGS. 39 and 40, reference numeral 100 is directed to a wafer-like block which is shaped to be readily connectable both to the mounting blocks 10, the driving blocks 20, the gear blocks 30 and blocks described in U.S. application Ser. No. 07/419,095 filed Oct. 10, 1989.

In essence, the wafer-like block 100 includes a top wall 102 which provides a first attachment surface and associated connecting means. Bottom wall 112 provides a second attachment surface with uniting means. A peripheral channel 120 defines a third attachment area. Note that walls 102 and 112 have a substantially square profile. Thus, the first building element is polygonal and has N sides, where N equals 4.

The top wall 102 is formed with a plurality of wedges 104 which are configured as right triangles oriented such that each right triangle has a hypotenuse which faces along a diagonal of the block. Thus, there are 2N wedges 104 for a total of 8 in this example.

A plurality of spaces 106 extend radially between adjacent wedges 104. These radially extending spaces 106 include deeper recesses 107 and describe the vanes 116 on the opposite side 112 of the block shown in FIG. 40. 2N spaces are provided which in this example provide a total of 8 spaces.

A central hole 108 is provided which entirely bisects the walls 102 and 112. The hole 108 is sized similarly to the orifice 80 in diameter. A collar 101 is located in the middle of the hole 108 which slightly reduces the diameter of the hole 108 in a central portion. The collar 101 is a distance from the walls 102, 112 equal to the length of the prominence 70 and the hub 60. Thus, the lip 71 of the prominence 70 and the lip 64 of the hub 60 may be held in place within the hole 108 by the collar 101. The hole 108 also has a plurality of undulations 184 which allow the hole 108 to hold the prominences 70 without allowing rotation.

Thus, in section a substantially U-shaped channel is provided where shelves 109 form the legs of the U-shaped channel. Collectively, the channel 120 defines a third attachment surface which mates with a projection 140 on two other adjacent sides. The projection 140 is of a thickness similar to the width to the channel 120 and of complemental shape so that a projection 140 may fit within the channel 120 of an adjoining wafer-like block 100. Raised beads are formed on each shelf 109 to coact with a trough formed on the projection 140, allowing the projection 140 to lock within the channel 120.

The truncations 152 of the wafer-like block 100 allow adjacent blocks to be placed in tangential registry in abutting relationship even at the corners. Stated alternatively, when four wafer-like blocks 100 are arranged in a 2×2 array. The truncations 152 allow clearance for the 2×2 array to be interconnected. In use and operation, the wafer-like blocks 100 may connect to prominences 70 or hubs 60 through the hole 108. Also, the spaces 106 between the wedges 104 are sized to fit over the rows 42 of posts 40 or over the vanes 46.

Moreover, having thus described the invention, it should be apparent that numerous structural modifications and adaptations may be resorted to without departing from the scope and fair meaning of the instant invention, as set forth hereinabove and as described hereinbelow by the claims.

I claim:

1. A toy construction set of distinct blocks comprising in combination:

a plurality of primary blocks having a top surface, a bottom surface and side surfaces; said top surface having an attachment means and said bottom surface having an attachment means which complements said top surface attachment means allowing said top surface of one of said primary blocks to connect to said bottom surface of another of said primary blocks, and said side surfaces having either a first protruding interfacing means or a second receiving interfacing means which are complemental to each other allowing one said side surface of one said primary block with said first interfacing means to connect with another said side surface of another said primary block with said second interfacing means; and a plurality of gear blocks having a top surface, a bottom surface and a cylindrical side surface; said top surface having an attachment means complemental to said bottom surface attachment means of said primary blocks which prevents relative rotation therebetween and said side surface having an interfacing means allowing one said gear block to tangentially contact another said gear block such that when one said gear block rotates another said gear block in contact with said gear block is rotated.

2. The toy construction set of claim 1 wherein said bottom surfaces of said gear blocks have attachment means allowing said bottom surface of said gear blocks to connect to said primary blocks with means allowing rotation but not axial translation.

3. The toy construction set of claim 2 wherein said first protruding interfacing means of said side surface of said primary blocks is a cylindrical prominence with a hollow core, said prominence extending outwardly orthogonally from said side surface, said prominence having a plurality of ribs fixedly attached to an outer surface of said prominence at uniform distances from each other and extending longitudinally thereupon and with a slit bisecting said prominence in a plane orthogonal to said side surface, whereby said prominence may be deflected to a lesser diameter by insertion of said prominence within a complementally formed orifice in another said primary block.

4. A toy gear set for educating children in the function of mechanical mechanisms comprising in combination:

a plurality of gear blocks, each gear block having a hub on a bottom surface, teeth on a side surface and a driving block attachment means on a top surface, a plurality of mounting blocks capable of fastening to each other with a plurality of complemental orifices and prominences on a plurality of side surfaces thereof and a plurality of said orifices on said top surface thereof, all of said orifices dimensioned to support said hubs of said gear blocks allowing rotation of said gears without translation, and a plurality of driving blocks having a prominence on a side surface thereof dimensioned to connect to said driving block attachment means on said gear top surface of said gear blocks while allowing free rotation thereon;

whereby said mounting blocks can be combined together with said orifices and said prominences in three perpendicular axes and said gear blocks may be combined with said mounting blocks through connection of said hubs into said orifices in an orientation where said teeth on said side surfaces of said gear blocks are engageable tangential to each other, thereby allowing an input force applied to said toy gear set to cause rotation of each of said gear blocks engaged directly or indirectly to a gear block receiving the input force within said toy gear set.

5. The toy gear set of claim 4 wherein said teeth on said side surface are beveled allowing said gear blocks to interface while within non-parallel rotational planes, whereby said gear blocks attached to said mounting blocks may rotate about three mutually perpendicular axes and interface together simultaneously, thereby representing the action of beveled gears.

6. The toy gear set of claim 4 wherein said mounting blocks each have a top surface and a bottom surface with complemental attachment means allowing said driving blocks and said mounting blocks to be stacked top-to-bottom.

7. The toy gear set of claim 6 wherein said top surface attachment means of said mounting blocks is a plurality of posts of equal width extending upwardly from said top surface in a radially symmetrical array, and wherein said bottom surface attachment means of said mounting blocks is a plurality of channels extending perpendicularly outward from said bottom surface, said channels being formed from a pair of parallel rectangular channel walls fixedly attached to said bottom surface, said channel walls being of similar distance apart as the width of said posts of said top surface, said channel walls being of similar height above said bottom surface as the length of said posts of said top surface;

whereby said channels of said bottom surface of said mounting block may fit over said posts of another said mounting block, thereby mating distinct said mounting blocks together securely in a top-to-bottom configuration with said bottom surface of said mounting block adjacent to said top surface of another said mounting block.

8. The toy gear set of claim 7 wherein said orifices of said mounting blocks are positioned on said side surfaces in locations allowing said hubs of adjacent said gear blocks to be connected within said orifices at positions providing appropriate interfacing of said teeth of said gear blocks in a planar fashion and in a non-planar beveled fashion.

9. A toy building block set including:

a primary building block comprising in combination a planar top surface, a planar bottom surface and a peripheral edge between said top and bottom surfaces, said top surface defining a first attachment surface, said bottom surface defining a second attachment surface, said first and second attachment surfaces defining complemental interconnecting contours of plural, centrally disposed, radially extending vanes of constant width centrally disposed on one said surface frictionally engageable within a series of complementally formed spaces on another said surface, said peripheral edge has mounted thereon a third attachment means connectable to other peripheral edges of other primary blocks of the set, said third attachment means including complementally formed projections and channels, and a fourth attachment means including a cylindrical hole in a center of said top and bottom surfaces which passes entirely through said primary block; and a secondary building block comprising in combination a planar top wall, a planar bottom wall and a peripheral edge between said top and bottom walls, said top wall having contours similar to that of said primary block top surface, said bottom wall having a cylindrical hub formed centrally thereon of complemental size and shape to said cylindrical hole of said primary block and said peripheral edge being cylindrical in shape and having a plurality of gear teeth formed thereon;

whereby a plurality of said primary blocks may be attached together along said peripheral edges utilizing said third attachment means and a plurality of said secondary blocks may be attached to said primary blocks by inserting said cylindrical hubs into said cylindrical holes of said primary blocks wherein said secondary blocks may freely rotate and causing said gear teeth of said secondary blocks to interface with each other such that when one said secondary block is rotated, other adjacent said secondary blocks will be caused to rotate, and wherein said second attachment surface of said primary blocks may connect to said first attachment surface of said top surface of said secondary blocks.

10. A building block having a top surface, a bottom surface opposite said top surface and a plurality of side surfaces, said top surface being equipped with a plurality of posts of equal width and length extending upwardly from said top surface, and said bottom surface being equipped with attachment means whereby multiple similar blocks are interconnectable serially by connecting said posts of said top surface to said attachment means of said bottom surface, wherein said posts have a toroidal flair circumscribing a periphery of each of said posts in a horizontal plane, whereby said posts may securely attach within said attachment means of another block, wherein said side surfaces have interfacing means which allow physical engagement between multiple said blocks, and wherein said side surface interfacing means includes a cylindrical prominence with a hollow core, said prominence extending outwardly orthogonally from one said side surface, said prominence having a plurality of ribs fixedly attached to the outer surface of said prominence at uniform distances from each other and extending longitudinally thereupon with a slit bisecting said prominence in a plane orthogonal to said side surface, whereby said prominence may be deflected to a greater diameter by insertion of another block's said post within said core, or deflected to lesser diameter by insertion of said prominence within an orifice defining a further said interfacing means located on another said block.

11. The block of claim 10 wherein said side surface interfacing means includes a cylindrical orifice extending inwardly orthogonally within said side surface, said orifice having a plurality of undulations formed on a side wall of said orifice, whereby said orifice may receive another block's prominence with said undulations of said orifice fitting complementally with ribs of another said block's prominence, thereby mating distinct blocks together with said side surface of said block adjacent to an adjoining block's side surface.

12. The block of claim 11 wherein said hollow core of said prominence has a non-uniform diameter with an inner end of said hollow core adjacent to said side wall of greater diameter than an outer end of said hollow core, whereby said post may be located within said inner end of said hollow core of said prominence, allowing said post to rotate freely within said core.

13. The block of claim 12 wherein said attachment means include channels which extend downwardly from said bottom surface, said channels being formed from a pair of parallel rectangular channel walls fixedly attached to said bottom surface and extending orthogonally from said bottom surface, said channel walls being of similar distance apart as a width of said posts of said top surface, whereby said channels of said bottom surface of said block may fit over another block's said posts, thereby mating distinct blocks together with said bottom surface of said block adjacent to the top surface of another block.

14. The block of claim 13 wherein walls of said channel are of similar depth above said bottom surface as the length of said posts of said top surface and said walls each have a ledge on a side facing an opposite channel wall of said channel thus positioned at a height which allows a toroidal flair of said post to be be held securely within said channel under said ledge, whereby adjoining blocks may be securely fastened together.

15. The block of claim 14 wherein a sum of rows of said posts of said top side are equal in number to the number of said channels, whereby said block may be fastened to other identical blocks, one of said rows of said posts residing within each said channel.

16. The block of claim 15 wherein said top wall has four of said rows of posts; said bottom wall has four of said channels and wherein said block has four of said side surfaces with three of said side surfaces including said orifice as said side surface interfacing means and one remaining said side surfaces including said prominence as said side surface interfacing means.

17. The block of claim 16 wherein walls of said channel are of planar rectangular construction and parallel to each other and form sides of a plurality of triangular wedges which extend below said bottom surface and which together define a flat plateau below said bottom surface, whereby said channel walls may be made more rigid and form an ornamental pattern.

18. The block of claim 17 wherein a cylindrical hole extends completely through said top surface and said bottom surface of said block which is sized to receive another block's prominence on either said top surface or said bottom surface, said hole having undulations to hold said prominence from rotation relative to said hole.

19. A toy construction set of distinct blocks, comprising in combination:

a plurality of primary blocks having a top surface, a bottom surface and side surfaces; said top surface having an attachment means and said bottom surface having an attachment means which complements said top surface attachment means allowing said top surface of one of said primary blocks to connect to said bottom surface of another of said primary blocks, and said side surfaces having either a first protruding interfacing means or a second receiving interfacing means which are complemental to each other allowing one said side surface of one said primary block with said first interfacing means to connect with another said side surface of another said primary block with said second interfacing means; and a plurality of gear blocks having a top surface, a bottom surface and a cylindrical side surface; said top surface having an attachment means complemental to said bottom surface attachment means of said primary blocks which prevents relative rotation therebetween and said side surface having an interfacing means allowing one said gear block to tangentially contact another said gear block such that when one said gear block rotates another said gear block in contact with said gear block is rotated, wherein said bottom surfaces of said gear blocks have attachment means allowing said bottom surface of said gear blocks to connect to said primary blocks with means allowing rotation but not axial translation, and wherein said first protruding interfacing means of said side surface of said primary blocks is a cylindrical prominence with a hollow core, said prominence extending outwardly orthogonally from said side surface, said prominence having a plurality of ribs fixedly attached to an outer surface of said prominence at uniform distances from each other and extending longitudinally thereupon and with a slit bisecting said prominence in a plane orthogonal to said side surface, whereby said prominence may be deflected to a lesser diameter by insertion of said prominence within a complementally formed orifice in another said primary block.

20. The toy construction set of claim 19 wherein said attachment means of said bottom surface of said gear block is a cylindrical hub with a hollow core, said hub extending outwardly orthogonally from said bottom surface, said hub having a slit bisecting said hub in a plane orthogonal to said bottom surface, whereby said hub may be deflected to a lesser diameter by insertion of said hub within a complementally formed orifice in another said primary block, with means allowing rotation but not axial translation of said hub of said gear block.

21. The toy construction set of claim 20 wherein said second receiving interfacing means of said side surface of said primary blocks is a cylindrical orifice extending inwardly orthogonally within said side surface, said orifice having a plurality of undulations formed on a side wall of said orifice, whereby said orifice may receive either said prominence of another said primary block or said hub of said gear block with said undulations of said orifice fitting complementally with said ribs of said prominence of another said primary block forming a non-rotating connection and fitting with said hub of said gear block without inhibiting rotation, thereby mating said primary blocks together or mating said primary block with said gear block.

22. The toy construction set of claim 21 wherein said cylindrical orifice is also included as an attachment means on said top surface of said primary block, whereby said prominence or said hub may be received on said top surface of said primary block.

23. The toy construction set of claim 22 wherein said first protruding interfacing means is a projection extending from said side surface in a plane parallel to said top surface of a width equal to the width of said side surface, and wherein said second receiving interfacing means is a groove extending into said side surface in a plane parallel to said top surface of a width equal to the width of said side surface and of complemental shape to said projection, whereby side surfaces of adjoining said primary blocks may be connected with said projection residing within said groove.

24. The toy construction set of claim 23 wherein said side surface interfacing means of said gear blocks is a plurality of beveled gear teeth, whereby said gear blocks may interface in a single plane as a planar gear pair or may interface in two planes as a beveled gear pair.

25. The toy construction set of claim 24 wherein said orifices of said primary blocks are positioned on said side surfaces such that when pairs of said primary blocks are attached along adjacent said side surfaces or along complemental said top surfaces and said bottom surfaces the distance between adjacent said orifices is substantially equal to a diameter of a pitch circle of said gear blocks, whereby said gear blocks may interface together when connected within adjacent said orifices of said primary blocks.

26. The toy construction set of claim 25 wherein said orifices of said side surfaces of said primary blocks are oriented on adjacent said side surfaces with a distance from a corner between adjacent said side surfaces substantially equal to a radius of said gear blocks, whereby said hubs of said gear blocks may connect within orifices of adjacent said side surfaces with said gear blocks contacting each other in different rotational planes parallel to said side surfaces of said primary block forming a beveled gear.

27. The toy construction set of claim 26 wherein said cylindrical orifice on said top surface is positioned such that when two of said primary blocks are attached along adjacent said side surfaces two of said gear blocks may be fastened to said top surfaces of said primary blocks allowing said gear blocks to interface with said gear teeth.

28. The toy construction set of claim 27 wherein said attachment means of said top surface of said primary blocks and said attachment means of said top surface of said gear blocks is a plurality of circular posts of equal diameter extending upwardly from said top surface in a plurality of linear rows which extend from a center of said top surface, said posts having a toroidal flair circumscribing a periphery of said posts in a horizontal plane;

and said top surface attachment means also including a plurality of rectangular vanes of a width substantially equal to a width of said posts and capable of attachment within a channel of constant width in a manner similar to that of a row of said posts.

29. The toy construction set of claim 28 wherein said attachment means of said bottom surface of said primary blocks is a plurality of channels extending radially outwardly from a center of said bottom surface, said channels being formed from a pair of parallel rectangular channel walls fixedly attached to said bottom surface and extending orthogonally from said bottom surface, said channel walls being of similar distance apart as the diameter of said posts of said top surface, whereby said channels of said bottom surface of said block may fit over said rows of said posts and said vanes of said other primary blocks, thereby mating primary blocks together or a primary block with a gear block with said bottom surface of said primary block adjacent to said top surface of either said primary block or said gear block.

30. The toy construction set of claim 29 wherein said channel walls are of similar height above said bottom surface as the length of said posts of said top surface and the height of said vanes, said channel walls each having a ledge on a side facing the other wall of said pair of walls positioned at a height which allows said toroidal flair of said posts to be held securely between said channel walls under said ledge, whereby said primary blocks, or said primary block and said gear block, may be securely fastened together in a variety of patterns including radial displacement and translational displacement of said primary blocks, or of said primary block and said gear block.

31. A toy construction set of distinct blocks, comprising in combination:

a plurality of primary blocks having a top surface, a bottom surface and side surfaces; said top surface having an attachment means and said bottom surface having an attachment means which complements said top surface attachment means allowing said top surface of one of said primary blocks to connect to said bottom surface of another of said primary blocks, and said side surfaces having either a first protruding interfacing means or a second receiving interfacing means which are complemental to each other allowing one said side surface of one said primary block with said first interfacing means to connect with another said side surface of another said primary block with said second interfacing means; and a plurality of gear blocks having a top surface, a bottom surface and a cylindrical side surface; said top surface having an attachment means and said side surface having an interfacing means allowing one said gear block to tangentially contact another said gear block such that when one said gear block rotates another said gear block in contact with said gear block is rotated, wherein said first protruding interfacing means of said side surface of said primary blocks is a cylindrical prominence with a hollow core, said prominence extending outwardly orthogonally from said side surface, said prominence having a plurality of ribs fixedly attached to an outer surface of said prominence at uniform distance from each other and extending longitudinally thereupon and with a slit bisecting said prominence in a plane orthogonal to said side surface, whereby said prominence may be deflected to a lesser diameter by insertion of said prominence within a complementally formed orifice in another said primary block.

32. The toy construction set of claim 31 wherein said second receiving interfacing means of said side surface of said primary blocks is a cylindrical orifice extending inwardly orthogonally within said side surface, said orifice having a plurality of undulations formed on a side wall of said orifice, whereby said orifice may receive either said prominence of another said primary block or a hub on said bottom surface of said gear block with said undulations of said orifice fitting complementally with said ribs of said prominence of another said primary block forming a non-rotating connection and fitting with said hub of said gear block without inhibiting rotation, thereby mating said primary blocks together or mating said primary block with said gear block.

33. A toy construction set of distinct blocks, comprising in combination:

a plurality of primary blocks having a top surface, a bottom surface and side surfaces; said top surface having an attachment means and said bottom surface having an attachment means which complements said top surface attachment means allowing said top surface of one of said primary blocks to connect to said bottom surface of another of said primary blocks, and said side surfaces having either a first protruding interfacing means or a second receiving interfacing means which are complemental to each other allowing one said side surface of one said primary block with said first interfacing means to connect with another said side surface of another said primary block with said second interfacing means; and a plurality of gear blocks having a top surface, a bottom surface and a cylindrical side surface; said top surface having an attachment means and said side surface having an interfacing means allowing one said gear block to tangentially contact another said gear block such that when one said gear block rotates another said gear block in contact with said gear block is rotated, wherein said bottom surfaces of said gear blocks have attachment means allowing said bottom surface of said gear blocks to connect to said primary blocks with means allowing rotation but not axial translation, wherein said attachment means of said bottom surface of said gear block is a cylindrical hub with a hollow core, said hub extending outwardly orthogonally from said bottom surface, said hub having a slit bisecting said hub in a plane orthogonal to said bottom surface, whereby said hub may be deflected to a lesser diameter by insertion of said hub within a complementally formed orifice in another said primary block, with means allowing rotation but not axial translation of said hub of said gear block.

34. The toy construction set of claim 33 wherein said side surface interfacing means of said gear blocks is a plurality of beveled gear teeth, whereby said gear blocks may interface in a single plane as a planar gear pair or may interface in two planes as a beveled gear pair.

* * * * *